US012390082B2

(12) United States Patent
Marzorati

(10) Patent No.: US 12,390,082 B2
(45) Date of Patent: Aug. 19, 2025

(54) DISHWASHER WITH COVER DEVICE

(71) Applicant: Electrolux Appliances Aktiebolag, Stockholm (SE)

(72) Inventor: Luca Marzorati, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 305 days.

(21) Appl. No.: 18/016,376

(22) PCT Filed: Jul. 17, 2020

(86) PCT No.: PCT/EP2020/070293
§ 371 (c)(1),
(2) Date: Jan. 16, 2023

(87) PCT Pub. No.: WO2022/012754
PCT Pub. Date: Jan. 20, 2022

(65) Prior Publication Data

US 2023/0270314 A1 Aug. 31, 2023

(51) Int. Cl.
*A47L 15/42* (2006.01)

(52) U.S. Cl.
CPC ..... *A47L 15/4265* (2013.01)

(58) Field of Classification Search
CPC ..... A47L 15/4265
See application file for complete search history.

(56) References Cited

U.S. PATENT DOCUMENTS

2009/0251036 A1 10/2009 Laible et al.

FOREIGN PATENT DOCUMENTS

| | | | | |
|---|---|---|---|---|
| DE | 2937384 A * | 4/1981 | ..... | A47L 15/4265 |
| DE | 602005000881 T2 | 12/2007 | | |
| EP | 819404 A2 * | 1/1998 | ..... | A47L 15/4265 |
| EP | 2407723 A2 | 1/2012 | | |
| SE | 454044 B | 3/1988 | | |

OTHER PUBLICATIONS

International Search Report and Written Opinion for International Application No. PCT/EP2020/070293, dated Mar. 23, 2021, 8 pages.

* cited by examiner

*Primary Examiner* — Michael E Barr
*Assistant Examiner* — Kevin G Lee
(74) *Attorney, Agent, or Firm* — Bradley Arant Boult Cummings LLP

(57) ABSTRACT

A dishwasher having a chamber, and a door assembly having a chamber door movable between closed and open positions. The door has an access aperture to access an adjusting member for adjusting a position of a decorative front panel relative to the door, and a sliding member that slides along a sliding axis during door movement. The sliding member is configured to slide the decorative front panel relative to the door along the sliding axis during door movement. A cover is mounted on the door assembly and configured to take a first operative position in which it uncovers the access aperture and a second operative position in which it covers at least partially the access aperture. The cover mechanically cooperates with the sliding member to automatically move from the first operative position to the second operative position in response to the sliding of the sliding member.

29 Claims, 25 Drawing Sheets

DISHWASHER WITH COVER DEVICE

This application is a U.S. National Phase application of PCT International Application No. PCT/EP2020/070293, filed Jul. 17, 2020, which is incorporated by reference herein.

FIELD OF THE INVENTION

The present invention relates to the field of electric appliances. Particularly, the present invention relates to the field of dishwashers. More particularly, the present invention relates to a dishwasher provided (or adapted to be provided with) with a cover device for safety purposes.

BACKGROUND ART

A conventional dishwasher comprises a (e.g., parallelepiped shaped) body or frame, which defines a (e.g., hollow) treatment chamber for items to be washed (the items to be washed comprising for example one or more among dishes, cutlery, glasses, pots and pans), and a door movable between closed and open positions for selectively accessing the treatment chamber.

The door is typically pivoted to a base of the dishwasher (by means of a pair of lateral hinges); in this way, the door may rotate (while moving between the closed and open positions) about a horizontal rotation axis raised from the floor.

A dishwasher may be either freestanding or integrated with other pieces of furniture. In the latter case (but not only), a decorative front panel (normally with the same appearance of the other pieces of furniture) may be installed on the door of the dishwasher.

In some countries, the decorative front panel has the same length as the door (with the base of the dishwasher that is covered by a baseboard, or plinth, of the kitchen); in other countries, instead, the decorative front panel is longer than the door (so as to project below it).

In both cases, a lower end of the decorative front panel may interfere with the baseboard when the door is in the open position (depending on a height of its pivoting area) or even during an initial movement of the door from the closed position.

EP2407723, filed by the same Applicant, addresses this issue.

EP2407723 discloses a sliding member configured to slide along a sliding axis during door movement, wherein the sliding member is coupleable to the decorative front panel such that, when coupled to the decorative front panel, a sliding of the sliding member during door movement causes the decorative front panel to slide with respect to the door along the sliding axis. EP2407723 also discloses an access aperture, formed at a door side, for allowing a user to access an adjusting member actuatable (by a user or an operator) to adjust a position of the decorative front panel with respect to the door.

SUMMARY OF THE INVENTION

The Applicant has understood that the solution disclosed in EP2407723 may give rise to safety issues.

Indeed, a user or an operator (or, even worse, a kid or a baby) may accidentally insert his/her fingers through the access aperture, and reach the sliding member (which could cause injury, such as cut or squashing).

In order to remedy such issues, a cap may be provided (e.g., as an accessory of the dishwasher) that the user or the operator has to mount on the access aperture after installation of the decorative front panel to the door. However, according to the Applicant, relying on the user or the operator to mount the cap does not solve the safety issues, in that the user or the operator may forget to do this or even overlook its importance.

In this respect, the Applicant has faced the above-mentioned issues, and has devised a dishwasher comprising a cover device configured to automatically move from a first operative position (in which the cover device leaves the access aperture of the door uncovered) and a second operative position (in which the cover device covers at least partially the access aperture of the door).

One or more aspects of the present invention are set out in the independent claims, with advantageous features of the same invention that are indicated in the dependent claims, whose wording is enclosed herein verbatim by reference (with any advantageous feature being provided with reference to a specific aspect of the present invention that applies mutatis mutandis to any other aspect).

More specifically, an aspect of the present invention relates to a dishwasher. The dishwasher comprises a frame defining a treatment chamber for items to be washed. The dishwasher comprises a door assembly. The door assembly comprises a door movable between closed and open positions for selectively accessing the treatment chamber. The door comprises an access aperture for allowing a user to access an adjusting member actuatable to adjust a position of a decorative front panel with respect to the door. The door assembly comprises a sliding member configured to slide along a sliding axis during door movement. The sliding member is coupleable to the decorative front panel such that, when coupled to the decorative front panel, a sliding of the sliding member during door movement causes the decorative front panel to slide with respect to the door along the sliding axis. The dishwasher comprises a cover device mounted or mountable on the door assembly and configured to take, when mounted on the door assembly, a first operative position in which the cover device leaves the access aperture of the door uncovered and a second operative position in which the cover device covers at least partially the access aperture of the door. The cover device is configured to mechanically cooperate with the sliding member so as to automatically move from the first operative position to the second operative position in response to the sliding of the sliding member.

The automatic movement of the cover device from the first operative position to the second operative position advantageously allows avoiding to rely on the user or the operator to cover the access aperture.

According to an embodiment, whose features are additional or alternative to any features of the previous embodiments, the cover device is mounted or mountable on the door.

The mounting of the cover device on the door advantageously allows the easy mounting of the cover device at the manufacturer site.

According to an embodiment, whose features are additional or alternative to any features of the previous embodiments, the door comprises a guiding member for guiding the cover device between the first and second operative positions, the cover device being configured to move from the first operative position to the second operative position by sliding along the guiding member.

The provision of a guiding member for guiding, by sliding, the cover device between the first and second operative positions advantageously allows achieving the automatic movement of the cover device in a simple, practical and effective manner.

According to an embodiment, whose features are additional or alternative to any features of the previous embodiments, the adjusting member is mechanically coupled to the sliding member so as to slide integrally to the sliding member during door movement. The cover device comprises an interception member configured to intercept the adjusting member during sliding thereof, while moving the door from the closed position to the open position the sliding of the adjusting member exerting on the interception member a force along the sliding axis that causes the cover device to move from first operative position to the second operative position.

The provision of an interception member intercepting the adjusting member advantageously allows achieving the automatic movement of the cover device by exploiting the movement of the adjusting member already provided in the dishwasher for allowing the translation of the decorative front panel in response to door (rotational) movement.

According to an embodiment, whose features are additional or alternative to any features of the previous embodiments, the cover device comprises an engaging member configured to engage an engaging region of the door in the first operative position of the cover device. Said force causes the engaging member to disengage from the engaging region of the door so as to move the cover device towards the second operative position.

The provision of an engaging member for engaging an engaging region of the door in the first operative position of the cover device allows achieving a stable coupling between the door and the cover device in the first operative position. This makes the mounting the cover device at the manufacturer site even more feasible, in that the engaging member prevents accidental detaching of the cover device (in the first operative position) from the door during shipping and/or installation of the dishwasher.

According to an embodiment, whose features are additional or alternative to any features of the previous embodiments, the cover device is configured to resiliently bend to allow the engaging member to disengage from the engaging region of the door so as to move the cover device from the first operative position to the second operative position.

The resilient bending of the cover device advantageously allows the cover device to be disengaged from the first operative position by mere action of the force applied by the adjusting member on the interception member.

According to an embodiment, whose features are additional or alternative to any features of the previous embodiments, the cover device comprises an engaging member configured to engage an engaging portion of the door in the second operative position of the cover device, said force causing the engaging member to engage the engaging portion of the door.

The provision of an engaging member for engaging an engaging portion of the door in the second operative position of the cover device allows achieving a stable coupling between the door and the cover device in the second operative position, which is therefore essentially unaffected by any subsequent door movement and/or by any accidental touches of the cover device.

According to an embodiment, whose features are additional or alternative to any features of the previous embodiments, the cover device is configured to automatically move from the first operative position to the second operative position in response to a first door movement, the engaging between the engaging member and the engaging portion allowing the cover device to be maintained in the second operative position at each door movement following the first door movement.

The automatic moving of the cover device from the first operative position to the second operative position and the maintaining of the cover device in the second operative position at each following door movement advantageously allows the cover device to cover the access aperture for all the lifetime of the dishwasher (unless the access aperture has to be uncovered to access the adjusting member, e.g. for maintenance purposes), thus avoiding injury risks and relieving the user from the burden of remembering to cover the access aperture.

According to an embodiment, whose features are additional or alternative to any features of the previous embodiments, the cover device is configured to be manually moved from the second operative position to the first operative position.

The manual moving of the cover device from the second operative position to the first operative position advantageously allows the uncovering of the access aperture only when necessary, and on purposive action by the user.

According to an embodiment, whose features are additional or alternative to any features of the previous embodiments, the door is configured to rotate between the closed and open positions about a rotation axis. The cover device is configured to be manually moved from the second operative position to the first operative position when the door is rotated with respect to the rotation axis by at least one predetermined rotation angle.

The manual movement of the cover device from the second operative position to the first operative position when the door is in one or more predetermined positions (such as when the door is rotated with respect to the rotation axis by at least one predetermined rotation angle) advantageously allows the uncovering of the access aperture only on a purposive action by the user.

According to an embodiment, whose features are additional or alternative to any features of the previous embodiments, each predetermined rotation angle corresponds to a distance along the sliding axis between the interception member of the cover device and the adjusting member, which distance is greater than a predetermined distance.

The manual movement of the cover device from the second operative position to the first operative position when the distance between the interception member and the adjusting member is greater than a predetermined distance advantageously allows avoiding that the interception member obstructs the cover device while moving towards the first operative position; this makes the gesture required to the manual moving of the cover device back to the first position simple (indeed, this gesture involve a downwards sliding movement when the door is in the closed or substantially closed position).

According to an embodiment, whose features are additional or alternative to any features of the previous embodiments, the access aperture is provided on a side wall of the door. The cover device being mountable or mounted on an external face of the side wall of the door.

The fact that the cover device is mountable or mounted on an external face of the side wall of the door advantageously allows the user to easily access the cover device, e.g. for manually moving it from the second operative position back to the first operative position.

According to an embodiment, whose features are additional or alternative to any features of the previous embodiments, the dishwasher comprises a guiding aperture provided at a side wall of the door. According to an embodiment, the guiding member comprises said guiding aperture.

The provision of a guiding aperture at a side of the wall acting as guiding member advantageously allows the cover device to be mounted externally to the door.

According to an embodiment, whose features are additional or alternative to any features of the previous embodiments, the cover device comprises at least one frictional member for providing a frictional coupling between the cover device and the door. According to an embodiment, the frictional member is configured to be retained by friction within the guiding member when no external force is applied to the cover device and to frictionally slide within the guiding member when an external force higher than a frictional force between the frictional member and the guiding member is applied to the cover device.

The provision of one or more frictional members advantageously allows achieving a backup coupling function between the cover device and the door (e.g., in case of break or damage of one or more engaging members of the cover device).

According to an embodiment, whose features are additional or alternative to any features of the previous embodiments, the cover device comprises at least one reinforcing member for reinforcing a coupling between the cover device and the door when the cover device is in the first operative position. According to an embodiment, the reinforcing member may be configured to abut against the access aperture (for example, a bottom of the access aperture) when the cover device is in the first operative position.

The provision of one or more reinforcing members for reinforcing a coupling between the cover device and the door when the cover device is in the first operative position advantageously allows achieving a backup coupling function between the door and the cover device in the first operative position (e.g., in case of break or damage of one or more engaging members of the cover device). This makes the mounting the cover device at the manufacturer site even more feasible, in that the reinforcing members prevent accidental detaching of the cover device (in the first operative position) from the door during shipping and/or installation of the dishwasher.

According to an embodiment, whose features are additional or alternative to any features of the previous embodiments, the access aperture comprises a first and a second access apertures. Said engaging portion of the door may comprise a portion of said first access aperture. The cover device may comprise an anti-release member for preventing the cover device from being accidentally decoupled from the door when the cover device is in the second operative position. According to an embodiment, the anti-release member may be configured to abut against a portion of the access aperture (e.g., of the second access aperture) when the cover device is in the second operative position.

The provision of the anti-release member advantageously allows achieving a backup coupling function between the door and the cover device in the second operative position (e.g., in case of break or damage of one or more engaging members of the cover device).

According to an embodiment, whose features are additional or alternative to any features of the previous embodiments, the cover device comprises a plate having an access hole matching the access aperture of the door in the first operative position of the cover device.

The provision in the cover device of an access hole matching the access aperture of the door in the first operative position of the cover device allows avoiding that the cover device, in the first operative position, obstructs an access of the user or the operator to the access aperture, and particularly that obstructs the insertion by the user or the operator of a screw driver or wrench to reach the adjusting member.

According to an embodiment, whose features are additional or alternative to any features of the previous embodiments, the door comprises an engaging hole for engaging the cover device and the door in the first operative position (the engaging region of the door for example comprising said engaging hole of the door). According to an embodiment, the cover device may be configured to engage a portion of the access aperture in the second operative position (the engaging portion of the door for example comprises a portion of the access aperture).

According to an embodiment, whose features are additional or alternative to any features of the previous embodiments, the sliding member is configured to slide, along the sliding axis, in a first direction when the door is moved from the closed position to the open position and in a second direction, opposite the first direction, when the door is moved from the open position to the closed position. According to an embodiment, the cover device moves in the first direction while automatically moving from first operative position to the second operative position; the force exerted on the cover device (e.g., on the interception member) that allows automatically moving the cover device from first operative position to the second operative position may for example comprise a first force in the first direction (said first force being for example a sliding force in the first direction). The cover device may be configured to be manually moved from the second operative position to the first operative position by exerting on the cover device a pulling force orthogonal to the sliding axis and a second force in the second direction along the sliding axis (said second force being a sliding force in the first direction).

The use of a pulling force and of a sliding force in the second direction to manually move the cover device from the second operative position to the first operative position advantageously allows the user to easily restore the cover device back to its first operative position.

Moreover, the concurrent application of the pulling and sliding forces is a sufficiently complex gesture that the manual movement from the second operative position to the first operative position has to be necessarily performed by the user purposely, which prevents that a kid or a baby could accidentally do it.

According to an embodiment, whose features are additional or alternative to any features of the previous embodiments, the cover device comprises at least one grip member for allowing the user to grasp the cover device.

The provision of the grip member advantageously allows the user to manually move the cover device between the first operative position and the second operative position. Particularly, the provision of the grip member advantageously allows the user to manually move the cover device from the second operative position to the first operative position, the grip member for example allowing the user to exert said pulling force and said second force easily and effectively.

According to an embodiment, whose features are additional or alternative to any features of the previous embodiments, the cover device comprises one or more flex grooves to enhance a resilience of the cover device during bending thereof.

The provision of flex grooves to enhance a resilience of the cover device during bending thereof advantageously prevents that the stiffening of the material over time due to aging causes the cover device to break.

According to an embodiment, whose features are additional or alternative to any features of the previous embodiments, the access aperture is provided at a side wall of the door. The cover device may be mounted on an internal face of the side wall of the door.

The provision of the cover device on the internal face of the side wall of the door prevents the user from accidentally accessing the cover device, and hence accidental moving thereof. Moreover, the provision of the cover device on the internal face of the side wall of the door determines a more agreeable appearance of the dishwasher.

According to an embodiment, whose features are additional or alternative to any features of the previous embodiments, the dishwasher comprises a guiding aperture provided at a front wall of the door orthogonal to the side wall of the door for guiding the cover device between the first and second operative positions. The cover device may comprise a plate configured to rest on the internal face of the side wall of the door, and an overhanging member projecting from the plate and configured to be coupled to the guiding aperture.

The provision of the overhanging member avoids structural modifications to the door, in that an elongated slot that, in some conventional dishwashers, is provided on the front wall of the outer door panel for assembling and adjusting the decorative front panel may be used as the guiding aperture (thus without the need of a dedicated guiding aperture).

According to an embodiment, whose features are additional or alternative to any features of the previous embodiments, the overhanging member is configured to engage the door. According to an embodiment, the overhanging member comprises said engaging member.

According to an embodiment, whose features are additional or alternative to any features of the previous embodiments, the cover device comprises at least one frictional member for providing a frictional coupling between the cover device and the door, the frictional member being configured to be retained by friction within the guiding member when no external force is applied to the cover device and to frictionally slide within the guiding member when an external force higher than a frictional force between the frictional member and the guiding member is applied to the cover device.

The provision of one or more frictional members advantageously allows achieving a backup coupling function between the cover device and the door (e.g., in case of break or damage of one or more engaging members of the cover device).

According to an embodiment, whose features are additional or alternative to any features of the previous embodiments, the engaging region of the door comprises a region of the guiding aperture, and the portion of the door comprises an engaging hole of the door.

According to an embodiment, whose features are additional or alternative to any features of the previous embodiments, the sliding member is configured to slide, along the sliding axis, in a first direction when the door is moved from the closed position to the open position and in a second direction, opposite the first direction, when the door is moved from the open position to the closed position. According to an embodiment, the cover device moves in the first direction while automatically moving from first operative position to the second operative position; the force exerted on the cover device (e.g., on the interception member) that allows automatically moving the cover device from first operative position to the second operative position may for example comprise a first force in the first direction (said first force being for example a sliding force in the first direction). The cover device may be configured to be manually moved from the second operative position to the first operative position by exerting a pushing force orthogonal to the sliding axis and a second force in the second direction along the sliding axis (said second force being a sliding force in the second direction).

The use of a pushing force and of a sliding force in the second direction to manually move the cover device from the second operative position to the first operative position advantageously allows the user to easily restore the cover device back to its first operative position.

Moreover, the concurrent application of the pushing and sliding forces is a sufficiently complex gesture that the manual movement from the second operative position to the first operative position has to be necessarily performed by the user purposely, which prevents that a kid or a baby could accidentally do it.

According to an embodiment, whose features are additional or alternative to any features of the previous embodiments, the cover device is mounted on the sliding member, whereby the cover device is configured to move from the first operative position to the second operative position when the door is moved from the closed position to the open position and to move from the second operative position to the first operative position when the door is moved from the open position back to the closed position.

The mounting of the cover device on the sliding member advantageously allows a completely automatic movement of the cover device between the first operative position and the second operative position.

According to an embodiment, whose features are additional or alternative to any features of the previous embodiments, the cover device is mounted on the sliding member by snap-fitting.

The mounting of the cover device on the sliding member by snap-fitting advantageously allows obtaining a simple, fast and effective coupling between the cover device and the sliding member.

BRIEF DESCRIPTION OF THE DRAWING

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS

Figure 1A:
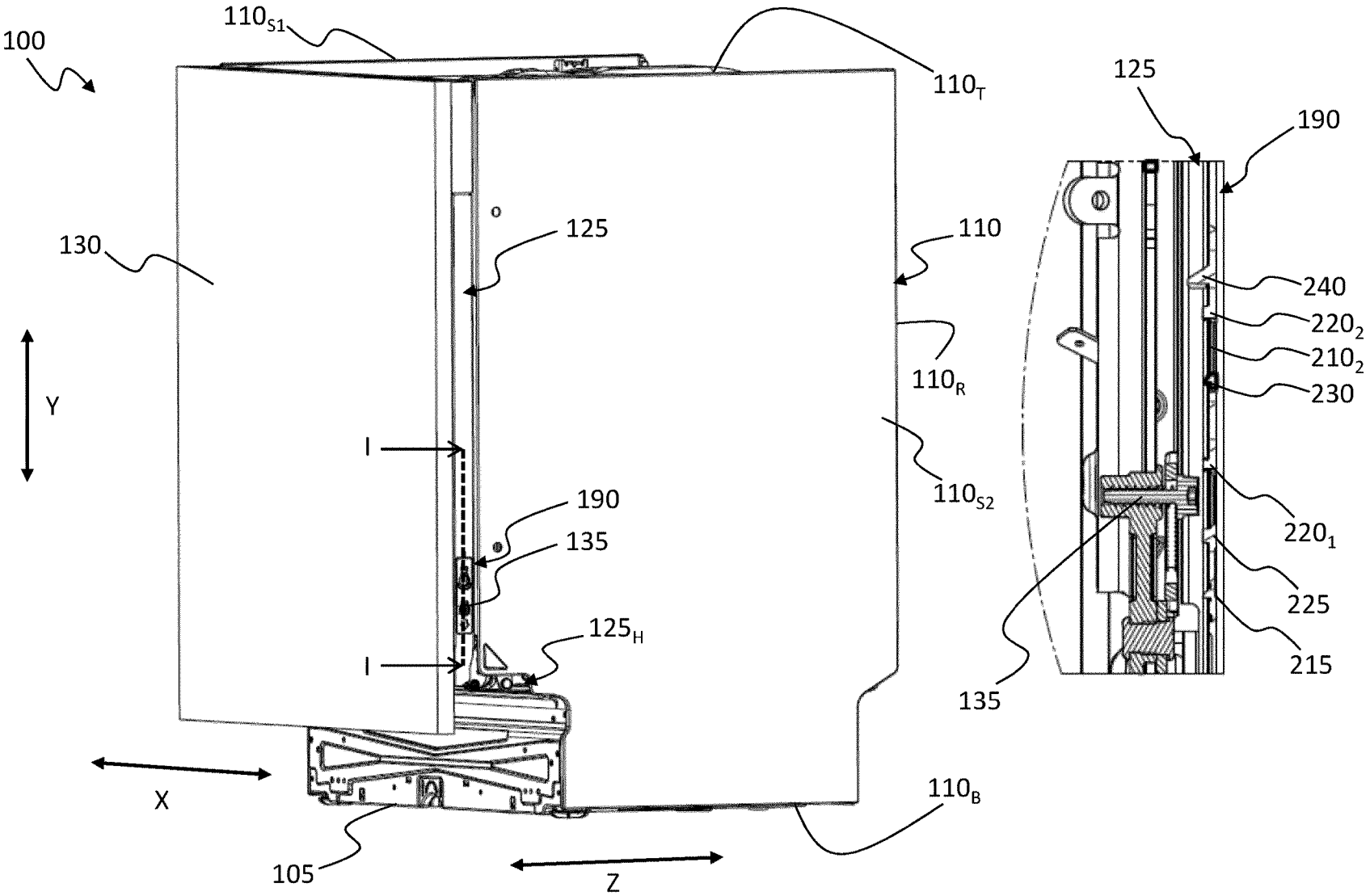
FIGS. 1A-1D show a dishwasher in different operative positions, according to an embodiment of the present invention.

The attached drawings essentially show, according to embodiments of the present invention, a dishwasher equipped with a cover device for safety purposes.

In the following, when one or more features of the dishwasher (as well as of components thereof) and of the cover device (as well as of components thereof) are introduced by the wording "according to an embodiment", they are to be construed as features additional or alternative to any features previously introduced, unless otherwise indicated and/or unless there is evident incompatibility among feature combinations.

In the following, only features of the dishwasher that are deemed relevant for the understanding of the present invention will be discussed, with well-known features and/or obvious variants of the relevant features that are omitted for the sake of conciseness.

In the following, directional terminology (such as top, bottom, front, rear, central, side, upper and lower) is only used for describing the dishwasher (as well as of components thereof) and the cover device (as well as of components thereof) according to the intended orientation use thereof, therefore directional terminology should be under no circumstances construed in absolute terms. In particular, the directional terminology is referred to mutually orthogonal reference axis X, Y, and Z, hereinafter referred to as longitudinal, vertical and transverse axis, respectively.

With reference to FIGS. 1A-1D, they show perspective side views of a dishwasher 100 in different operative positions, according to an embodiment of the present invention. Each one of the FIGS. 1A-1D also shows a sectional view of the dishwasher 100 along the I-I sectional axis, each sectional view illustrating a respective interaction between the cover device and a door of the dishwasher 100.

According to an embodiment the dishwasher 100 comprises a base 105 for resting the dishwasher 100 on a support surface (not shown in the figures), e.g. parallel to the plane defined by the longitudinal X and transverse Z axis (hereinafter, X-Z plane), such as a floor or a support surface of a suitable niche of a piece of furniture wherein the dishwasher 100 can be installed.

According to an embodiment, the dishwasher 100 comprises a (e.g., parallelepiped shaped) body or frame 110.

According to an embodiment, the frame 110 defines a (e.g., hollow) treatment chamber 115 for items to be washed. According to an embodiment, the items to be washed comprise one or more among dishes, cutlery, glasses, pots and pans.

According to an embodiment, the dishwasher 100 comprises, within the treatment chamber 115, one or more pullout racks (not shown in the figures) for inserting the items to be washed into the treatment chamber 115.

According to an embodiment, the frame 110 comprises top $\mathbf{110}_T$ and bottom $\mathbf{110}_B$ walls parallel to the X-Z plane, a rear wall $\mathbf{110}_B$ parallel to the plane defined by the longitudinal X and vertical Y axis (hereinafter, X-Y plane), and two side walls $\mathbf{110}_{S1}$,$\mathbf{110}_{S2}$ orthogonal to the top $\mathbf{110}_T$, bottom $\mathbf{110}_B$ and rear $\mathbf{110}_R$ walls (i.e., parallel to the plane defined by the vertical Y and transverse Z axis, hereinafter Y-Z plane). External faces of the side walls $\mathbf{110}_{S1}$, $\mathbf{110}_{S2}$, i.e. the faces of the side walls $\mathbf{110}_{S1}$, $\mathbf{110}_{S2}$ that do not face the treatment chamber 115, are usually covered by external side panels (not shown in the figures), typically part of the piece of furniture wherein the dishwasher 100 is installed.

According to an embodiment, the frame 110 defines a front load opening 120 parallel to the X-Y plane, and opposite to the rear wall $\mathbf{110}_R$ along the transverse axis Z.

According to an embodiment, the dishwasher 100 comprises a door assembly.

According to an embodiment, the door assembly comprises a door 125 for selectively opening the front load opening 120, and hence for selectively accessing the treatment chamber 115.

According to an embodiment, the door 125 is movable (e.g., rotatable) between closed and open positions.

Figure 1B:
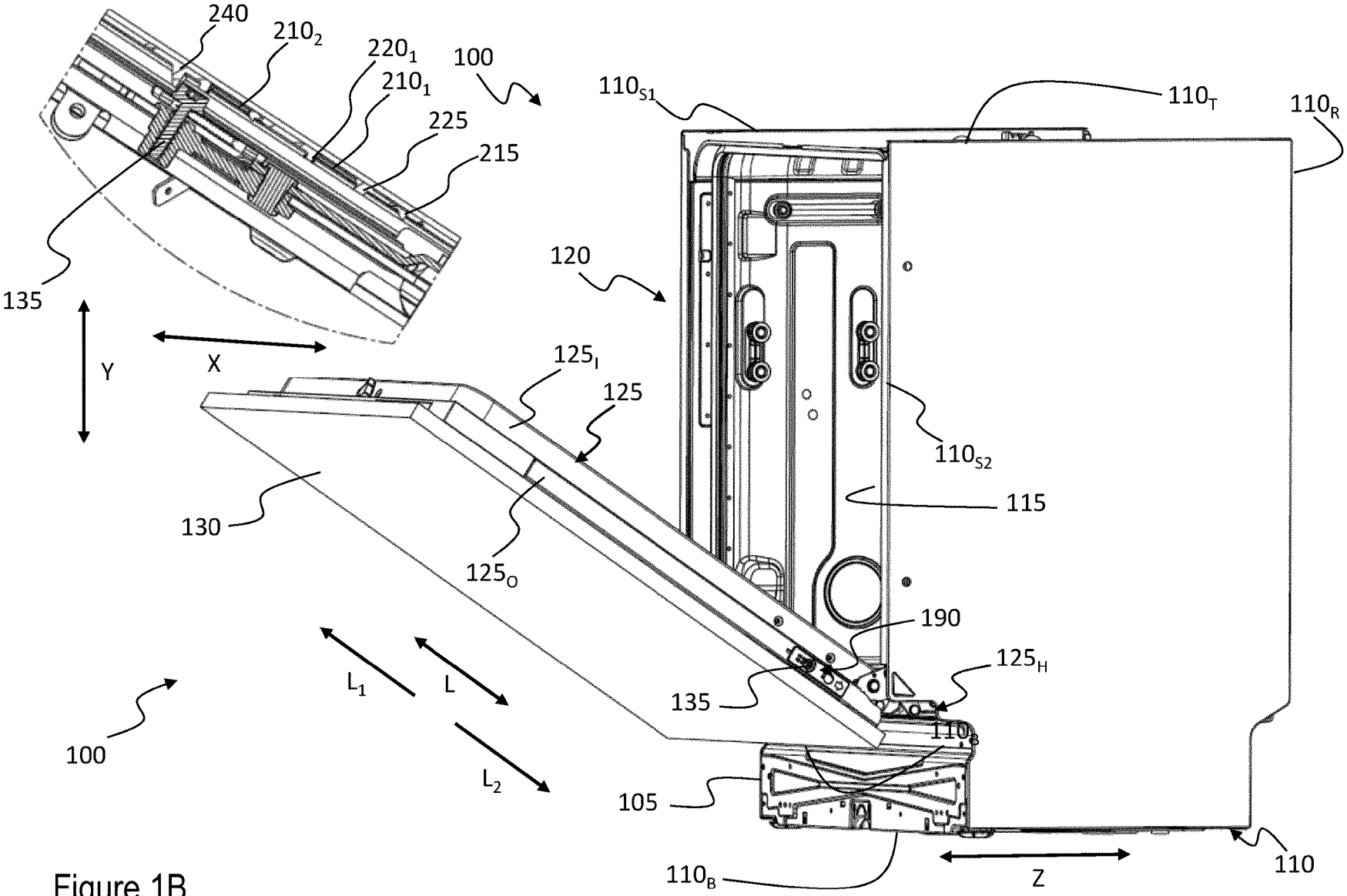
Figure 1C:
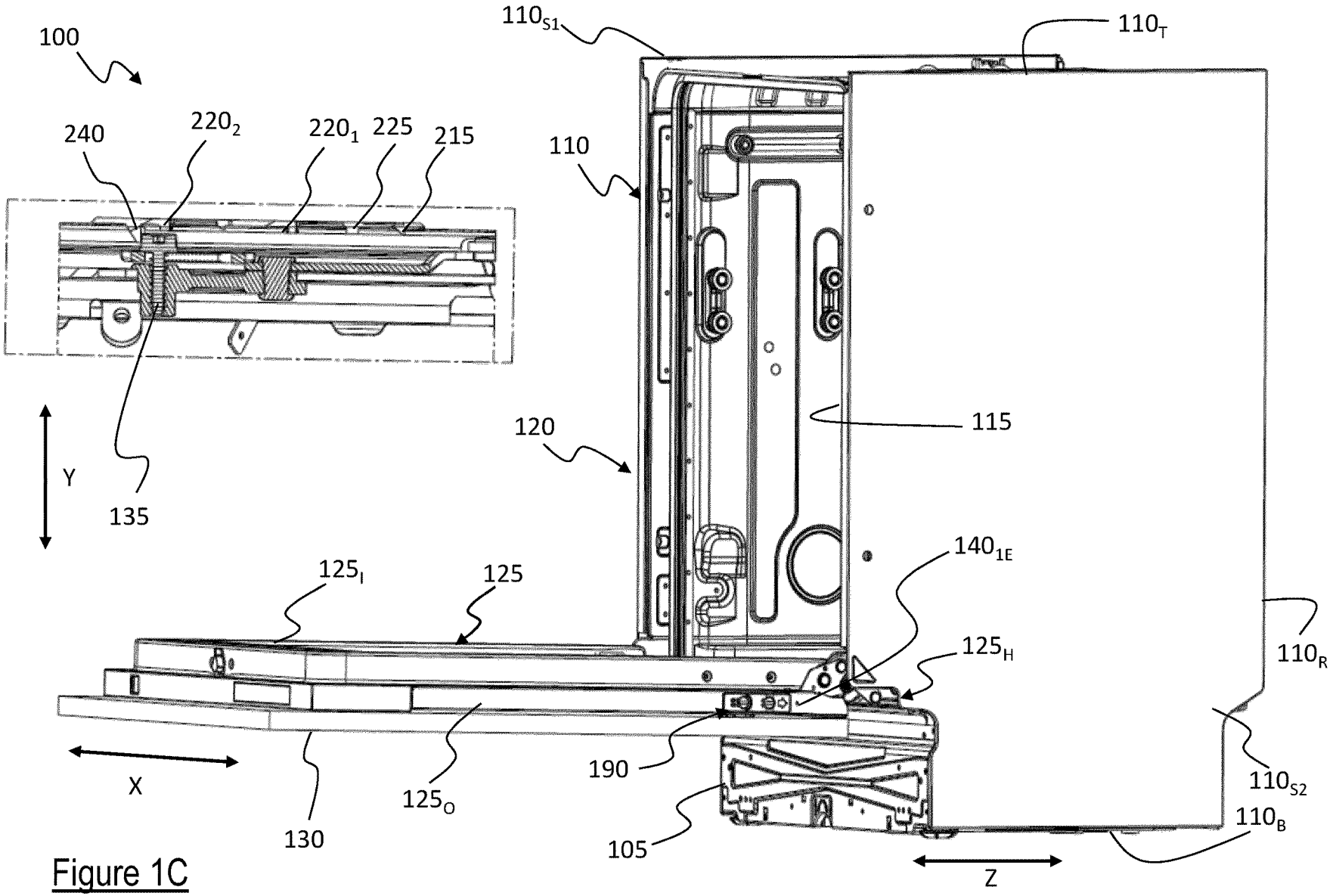
Figure 1D:
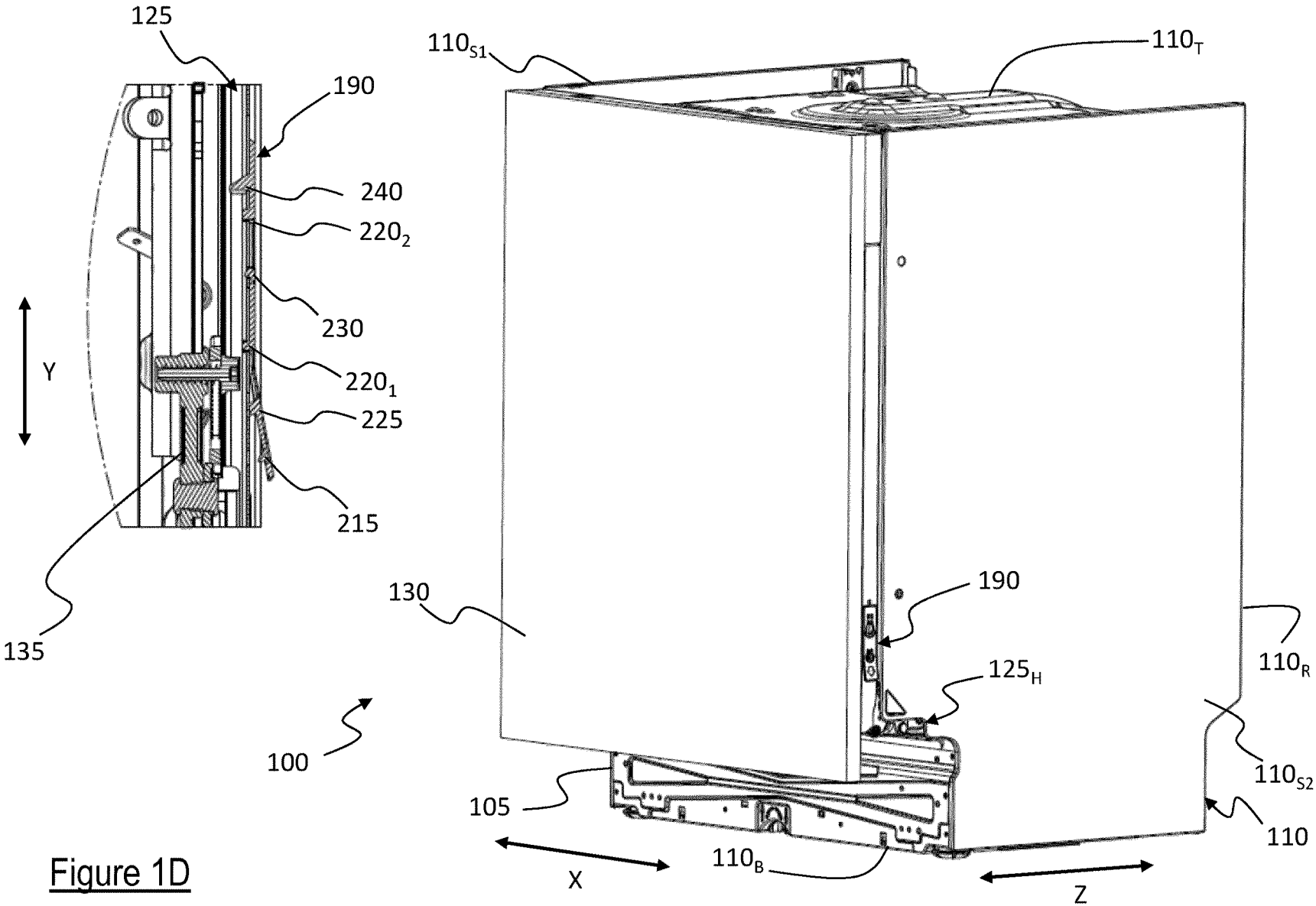

The door 125 is exemplary shown in the closed position in FIGS. 1A and 1D, in a partially open position in FIG. 1B and in the open position in FIG. 1C.

According to an embodiment, the door 125 comprises an outer door panel $\mathbf{125}_O$ and an inner door panel $\mathbf{125}_I$.

According to an embodiment, the inner door panel $\mathbf{125}_I$ is mounted on a rear face of the outer door panel $\mathbf{125}_O$, the rear face of the outer door panel $\mathbf{125}_O$ for example facing the treatment chamber 115 when the door 125 is in the closed position.

According to an embodiment, the outer $\mathbf{125}_O$ and inner $\mathbf{125}_I$ door panels are sized such that, upon outer $\mathbf{125}_O$ and inner $\mathbf{125}_I$ door panels mounting, a portion (preferably, a perimeter edge portion) of the rear face of the outer door panel $\mathbf{125}_O$ is uncovered by the inner door panel $\mathbf{125}_I$ and acts as an abutment portion (preferably, a perimeter abutment portion) abutting against borders of the front load opening 120 to seal the treatment chamber 115 when the door 125 is in the closed position.

According to an embodiment, the door assembly comprises a door hinge $\mathbf{125}_H$ for rotationally coupling the door 125 to the base 105, so that the door 125 can rotate with respect to the frame 110 about a horizontal rotation axis (raised from the floor), e.g. parallel to the longitudinal axis X. According to an embodiment, the door 125 can be moved from the closed position to the open position by a drop-down movement, and from the open position to the closed position by a pull-up movement.

According to an embodiment, the dishwasher 100 may be a fully-integrated dishwasher or a semi-integrated dishwasher. By fully integrated dishwasher it is herein meant that, when the door 125 is in the closed position, the dishwasher 100 may be totally indistinguishable from the other pieces of the furniture where it is installed. By semi-integrated dishwasher it is herein meant that, when the door 125 is in the closed position, the dishwasher 100 may be partially indistinguishable from the other pieces of the furniture where it is installed. For this purpose, upon dishwasher installation, the door 125 may be coupled to a decorative front panel 130 so as to be completely or almost completely covered by it. According to an embodiment, the decorative front panel 130, which is not part of the dishwasher 100, has same appearance as, or it is at least coordinated with, the other pieces of the furniture, the decorative front panel 130 being for example made of wood.

According to an embodiment, the door hinge $\mathbf{125}_H$ comprises a fastening system for fastening the decorative front panel 130 to the door 125 and for adjusting a position (i.e. a vertical position, taking the door 125 in the closed position as a reference) of the decorative front panel 130 with respect to the door 125. The fastening system, not entirely visible in FIGS. 1A-1D, will be better discussed in the following.

For the purposes of the present disclosure, the fastening system comprises an actuatable or adjusting member, for example a trimming screw 135 (e.g., made of a metal material or other rigid material) adapted to be screwed/unscrewed or rotated by the user or the operator.

According to an embodiment, the door comprises one or more access apertures for allowing the user or the operator to access and actuate (e.g., by insertion of a screw driver or wrench) the trimming screw 135.

According to an embodiment, the access aperture(s) are provided at the outer door panel $\mathbf{125}_O$, e.g. at a lower end region of a side wall thereof that is visible by the user when the door 125 is not in the closed position.

Figure 1E:
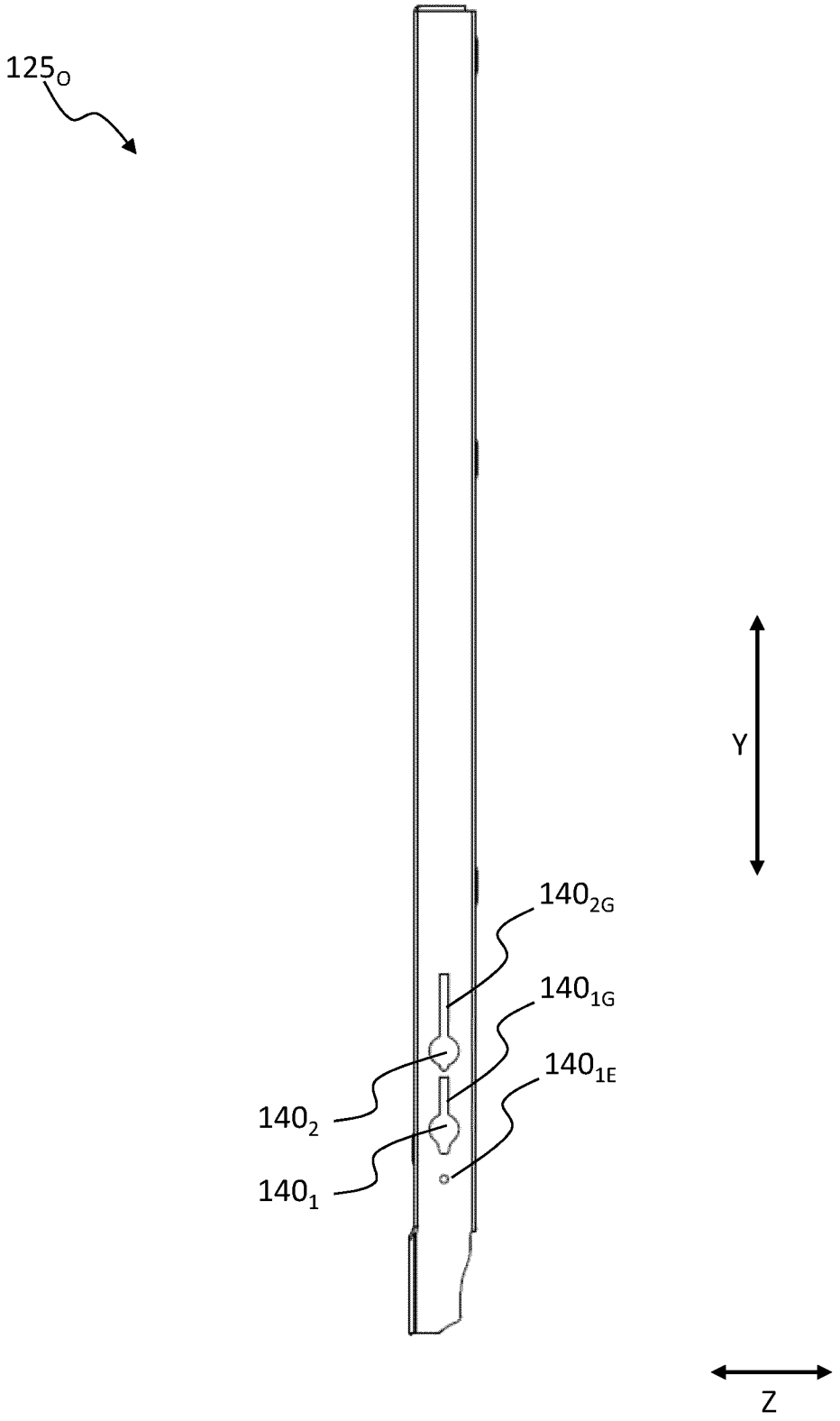
FIG. 1E shows a portion of a door of the dishwasher of FIGS. 1A-1D according to an embodiment of the present invention.

With reference also to FIG. 1E, it shows an external face of the door side wall, and particularly the external face of the side wall of the outer door panel $\mathbf{125}_O$, according to an embodiment of the present invention.

According to an embodiment, the outer door panel $\mathbf{125}_O$, comprises two access apertures $\mathbf{140}_1$,$\mathbf{140}_2$. According to an embodiment, the access apertures $\mathbf{140}_1$,$\mathbf{140}_2$ are aligned to each other along the vertical axis Y, so as to define a lower access aperture $\mathbf{140}_1$ and an upper access aperture $\mathbf{140}_2$ (taking the orientation of use of the dishwasher 100 and the door 125 in the closed position as references).

According to an embodiment, each access aperture $\mathbf{140}_1$, $\mathbf{140}_2$ is designed (i.e., shaped and sized) to allow the user to access and actuate the trimming screw 135 in respective positions of the door 125 (as better discussed in the following, the trimming screw 135 moves in response to door movement, whereby the trimming screw 135 may be accessed through the lower access aperture $\mathbf{140}_1$ or through the upper access aperture $\mathbf{140}_2$ depending on a position of the door 125).

According to an embodiment, the lower access aperture $\mathbf{140}_1$ is designed to allow the user to access and actuate the trimming screw 135 when the door 125 is almost in the closed position, e.g. for assembling the decorative front panel 130 on the door 125.

According to an embodiment, the upper access aperture $\mathbf{140}_2$ is designed (i.e., shaped and sized) to allow the user to access and actuate the trimming screw 135 when the door 125 is in a predetermined (e.g., substantially intermediate) position between the closed and open positions (the intermediate position corresponding for example to about a 45-degree rotation angle of the door 125 with respect to the vertical axis Y), e.g. for adjusting the vertical position of the decorative front panel 130 on the door 125 and/or for disassembling the decorative front panel 130 from the door 125.

According to an embodiment, each access aperture $\mathbf{140}_1$, $\mathbf{140}_2$ is circular (or substantially circular) in shape, and is large enough to allow the user or the operator to access and actuate (e.g., by insertion of a screw driver or wrench) the trimming screw 135.

According to an embodiment, the door 125 comprises, e.g. at the side of the outer door panel $\mathbf{125}_O$, one or more guiding members, such as one or more guiding apertures. According to an embodiment, the door 125 comprises, e.g. at the side of the outer door panel $\mathbf{125}_O$, two guiding apertures $\mathbf{140}_{1G}$,$\mathbf{140}_{2G}$, each guiding aperture $\mathbf{140}_{1G}$,$\mathbf{140}_{2G}$ being preferably associated with a respective access aperture $\mathbf{140}_1$,$\mathbf{140}_2$. According to an embodiment, the guiding apertures $\mathbf{140}_{1G}$,$\mathbf{140}_{2G}$ are aligned to each other along the vertical axis Y. According to an embodiment, each guiding aperture $\mathbf{140}_{1G}$,$\mathbf{140}_{2G}$ extends along the vertical axis Y, each guiding aperture $\mathbf{140}_{1G}$,$\mathbf{140}_{2G}$ being for example elongated in shape. According to an embodiment, each guiding aperture $\mathbf{140}_{1G}$,$\mathbf{140}_{2G}$ is arranged at (and extends from) a top of a respective access aperture $\mathbf{140}_1$,$\mathbf{140}_2$. According to an embodiment, the guiding aperture $\mathbf{140}_{1G}$ opens to (e.g., the top of) the lower access aperture $\mathbf{140}_1$ (reason why it will be referred to as lower guiding aperture $\mathbf{140}_{1G}$), and the guiding aperture $\mathbf{140}_{2G}$ opens to (e.g., the top of) the upper access aperture $\mathbf{140}_2$ (reason why it will be referred to as upper guiding aperture $\mathbf{140}_{2G}$).

According to an embodiment, the guiding apertures $\mathbf{140}_{1G}$,$\mathbf{140}_{2G}$ are designed to allow movement/sliding of the cover device during movement/sliding of the decorative front panel 130 with respect to the door 125 (so as to cover the access apertures $\mathbf{140}_1$,$\mathbf{140}_2$, as better discussed in the following). As better discussed in the following, the guiding apertures $\mathbf{140}_{1G}$,$\mathbf{140}_{2G}$ allow guiding the cover device between a first operative position in which the cover device leaves the access apertures $\mathbf{140}_1$,$\mathbf{140}_2$ uncovered (hereinafter, opening position) and a second operative position in which the cover device covers at least partially the access apertures $\mathbf{140}_1$,$\mathbf{140}_2$ (hereinafter, closing position). As better discussed in the following, the cover device is configured to move or switch from the opening position to the closing position by sliding along the guiding apertures $\mathbf{140}_{1G}$,$\mathbf{140}_{2G}$ (or by sliding along a single guiding aperture, e.g. in embodiments in which a single access aperture and a single guiding aperture are provided).

According to an embodiment, the door 125 comprises, e.g. at the side of the outer door panel $\mathbf{125}_O$, an engaging region or portion, for example an engaging hole $\mathbf{140}_{1E}$. According to an embodiment, the engaging hole $\mathbf{140}_{1E}$ is provided, along the vertical axis Y, below the lower access aperture $\mathbf{140}_1$.

As better discussed in the following, the engaging hole $\mathbf{140}_{1E}$ is designed to receive an engaging member (such as an engaging tooth) of the cover device, e.g. so as to stably retain the cover device in the opening position. Therefore, the cover device can be advantageously mounted on the door assembly at manufacturer site (thus relieving the user from this burden).

According to an embodiment, the door hinge $\mathbf{125}_H$ comprises a sliding system, not visible in FIGS. 1A-1D, for allowing the decorative front panel 130 to slide with respect to the door 125 during door movement (i.e., when the door 125 is moved between the closed and open positions).

According to an embodiment, the sliding system is configured to slide along a sliding axis L essentially orthogonal to the rotation axis of the door 125 (the sliding axis being parallel to the vertical axis Y when the door 125 is in the closed position, and to the transverse axis Z when the door 125 is in the open position). According to an embodiment, the sliding system is configured to slide, along the sliding axis L, in a first direction $L_1$ (hereinafter, forward direction) when the door 125 is moved from the closed position to the open position and in a second direction $L_2$ (hereinafter, backward direction), opposite to the forward direction $L_1$, when the door 125 is moved from the open position to the closed position.

As better discussed in the following, the sliding system is coupleable to the decorative front panel 130 such that, when coupled to the decorative front panel 130, a sliding of the sliding system during door movement causes the decorative front panel 130 to slide with respect to the door 125 along the sliding axis L, thus avoiding interferences of the decorative front panel 130 with any furniture baseboard (not shown).

As better discussed in the following, the fastening system is mechanically coupled to the sliding system so as to slide integrally to the sliding system during door movement, the trimming screw 135 being thus movable along the sliding axis L with the sliding of the sliding system (and, hence, with the door movement).

Figure 1F:
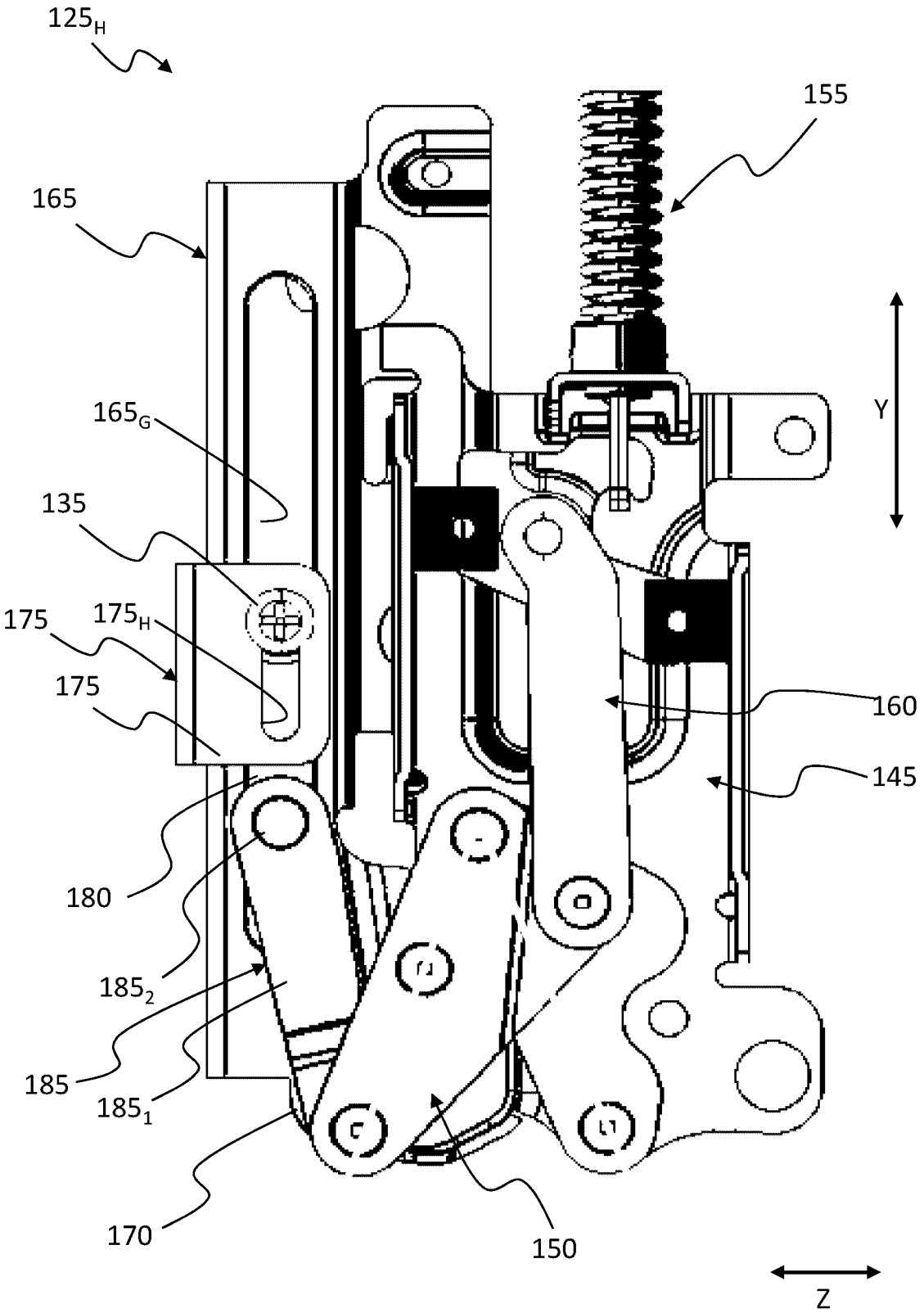
FIGS. 1F-1H show a door hinge of the dishwasher of FIGS. 1A-1D, according to an embodiment of the present invention.
Figure 1G:
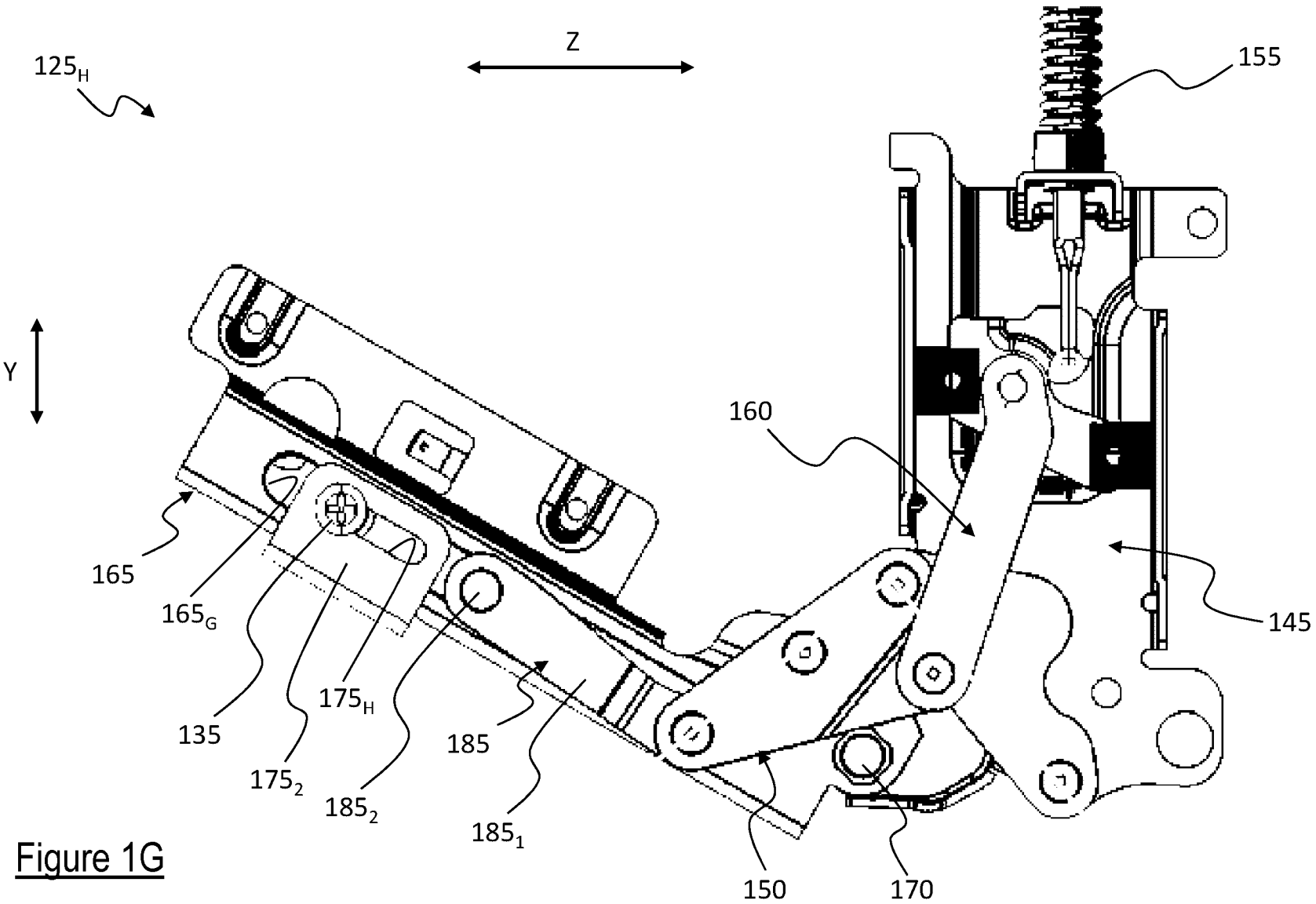
Figure 1H:
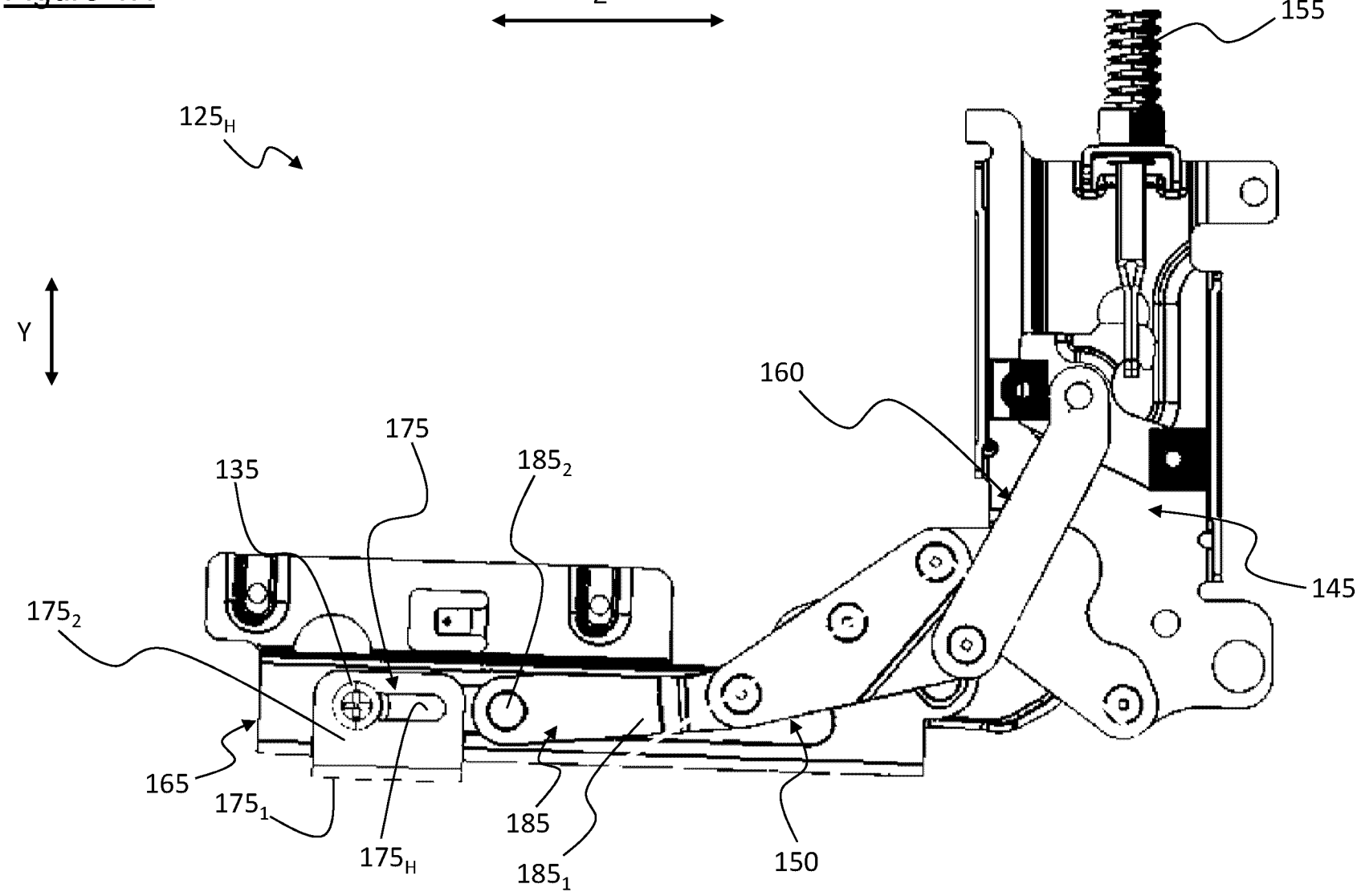

With reference also to FIGS. 1F-1H, they show the door hinge $\mathbf{125}_H$ in different operative positions, according to an embodiment of the present invention.

According to an embodiment, the door hinge $\mathbf{125}_H$ is analogous to the door hinge disclosed in EP2407723 (the entire disclosure of which is incorporated by reference).

According to an embodiment, the door hinge $\mathbf{125}_H$ comprises a support bracket 145 for connecting the door hinge $\mathbf{125}_H$ to the frame 110—for example, by means of corresponding screws (not shown).

According to an embodiment, the door hinge $\mathbf{125}_H$ comprises a driving mechanism 150. According to an embodiment, the driving mechanism 150 is of a lever type.

According to an embodiment, the door hinge $\mathbf{125}_H$ comprises a door balancing device 155 configured to counterbalance a weight of the door 125, with its decorative front panel (not shown in the figure).

According to an embodiment, the door hinge $\mathbf{125}_H$ comprises a coupling mechanism 160 for coupling the driving mechanism 150 and the balancing device 155 to each other.

According to an embodiment, the door hinge $\mathbf{125}_H$ comprises a rotating bracket 165 for connecting the door 125 and the door hinge $\mathbf{125}_H$ to each other. According to an embodiment, the rotating bracket 165 is rotationally connected to the support bracket 145 by means of a fulcrum pin 170; in this way, the door 125 (connected to the rotating bracket 165) can rotate with respect to the frame 110 (connected to the support bracket 145) about the fulcrum pin 170, which then defines its rotation axis.

According to an embodiment, the rotating bracket 165 comprises an elongated guide structure $\mathbf{165}_G$, which extends essentially orthogonally relative to the rotation axis of the door 125 (the elongated guide structure $\mathbf{165}_G$ thus extending along the sliding axis L). According to an embodiment, the elongated guide structure $\mathbf{165}_G$ comprises an elongated access window provided along the rotating bracket 165, e.g. essentially in the middle of the rotating bracket 165.

According to an embodiment, the fastening system comprises the trimming screw 135.

According to an embodiment, the fastening system comprises a fastening bracket 175. According to an embodiment, the fastening bracket 175 has a L-shaped profile, the fastening bracket for example comprising a first plate $\mathbf{175}_1$ parallel, in use, to the decorative front panel 130 (hereinafter, longitudinal plate $\mathbf{175}_1$), and a second plate $\mathbf{175}_2$, orthogonal to the first plate $\mathbf{175}_1$, parallel, in use, to the rotating bracket 165 (hereinafter, transverse plate $\mathbf{175}_2$). According to an embodiment, the longitudinal plate $\mathbf{175}_1$ of the fastening bracket 175 comprises one or more (e.g., two) holes configured to receive respective fastening screws, for example self-tapping screws (not shown in the figure), screwed into the decorative front panel 130 (so as to grip the fastening bracket 175, and particularly the longitudinal plate $\mathbf{175}_1$ thereof, against the decorative front panel 130).

According to an embodiment, the fastening bracket 175 comprises, e.g. at the transverse plate $\mathbf{175}_2$ thereof, a trimming slotted hole $\mathbf{175}_H$. As better discussed in the following, the trimming screw 135 is configured to be inserted through the trimming slotted hole $\mathbf{175}_H$ to mechanically couple the fastening system to the sliding system, so as to allow the decorative front panel to slide with respect to the door 125 during door movement.

According to an embodiment, the sliding system comprises a sliding member 180, which is slidably guided along the elongated guide structure $\mathbf{165}_G$ of the rotating bracket 165.

According to an embodiment, the sliding member 180 comprises a threaded hole (not shown in the figure) adapted to receive the trimming screw 135. According to an embodiment, by inserting (and screwing) the trimming screw 135 through the trimming slotted hole $\mathbf{175}_H$, the access window of the elongated guide structure $\mathbf{165}_G$, and the threaded hole of the sliding member 180, the fastening bracket 175 is gripped against the sliding member 180. According to an embodiment, the fastening bracket 175 abuts against a spacer (not indicated in the figures) of the sliding member 180 that maintains the fastening bracket 175 spaced apart from the elongated guide structure $\mathbf{165}_G$, so as to allow its sliding together with the sliding member 180.

According to an embodiment, the sliding system comprises a crank mechanism 185 connected between the driving mechanism 150 and the sliding member 180, so as to convert a rocking movement of the driving mechanism 150 into a translation of the sliding member 180 (so as to achieve the above-mentioned sliding of the sliding member 180 along the elongated guide structure $\mathbf{165}_G$, and the corresponding sliding of the fastening bracket 175, and hence of the decorative front panel 130 fixed thereto, with respect to the door 125).

According to an embodiment, the crank mechanism 185 comprises a transmission arm $\mathbf{185}_1$ coupled, at a first end thereof, to a rocking arm of the driving mechanism 150, and at a second end thereof, to the sliding member 180 by means of a pin $\mathbf{185}_2$ (the transmission arm $\mathbf{185}_1$ being for example coupled to the sliding member 180 at a lower end thereof, below the fastening bracket 175).

As visible in FIG. 1F, when the door 125 (not shown) is in the closed position, the rotating bracket 165 extends along the vertical axis Y in contact with the support bracket 145, and the sliding member 180 is at a lower position along the elongated guide structure $\mathbf{165}_G$.

As visible in FIG. 1G, when the door 125 (not shown in this figure) is in a partially open position, the rotating bracket 165 (connected to the door 125) rotates with respect to the support bracket 145 about the fulcrum pin 170, so as to move away from the support bracket 145 (connected to the frame 110, not shown in this figure). The corresponding rotation of the rocking arm of the driving mechanism 150 pushes the transmission arm $\mathbf{185}_1$ away from the fulcrum pin 170, so as to translate the sliding member 180 (and the fastening bracket 175 coupled thereto) along the elongated guide structure $\mathbf{165}_G$.

As visible in FIG. 1H, the rotation of the rotating bracket 165 (and, hence, the opening of the door 125, not shown in this figure) stops when it reaches a maximum opening angle of about 85-90° (for example, with the rotating bracket 165 that abuts against a bottom of the support bracket 145). According to an embodiment, in this position the sliding member 180 reaches an end of stroke of the elongated guide structure $\mathbf{165}_G$.

Back to FIGS. 1A-1E, as mentioned above, the dishwasher 100 comprises a cover device 190 mountable on the door assembly and configured to take, when mounted on the door assembly, the opening position (in which the cover device 190 leaves the access apertures $\mathbf{140}_1$,$\mathbf{140}_2$ of the door 125 uncovered), and the closing position (in which the cover device 190 covers at least partially, preferably completely, the access apertures $\mathbf{140}_1$,$\mathbf{140}_2$ of the door 125).

According to an embodiment, in the closing position the cover device 190 covers both the access apertures $\mathbf{140}_1$, $\mathbf{140}_2$.

According to an embodiment, the cover device 190 is configured to mechanically cooperate/interact with the sliding system so as to automatically move from the opening position to the closing position in response to the sliding of the sliding system.

Figure 2A:
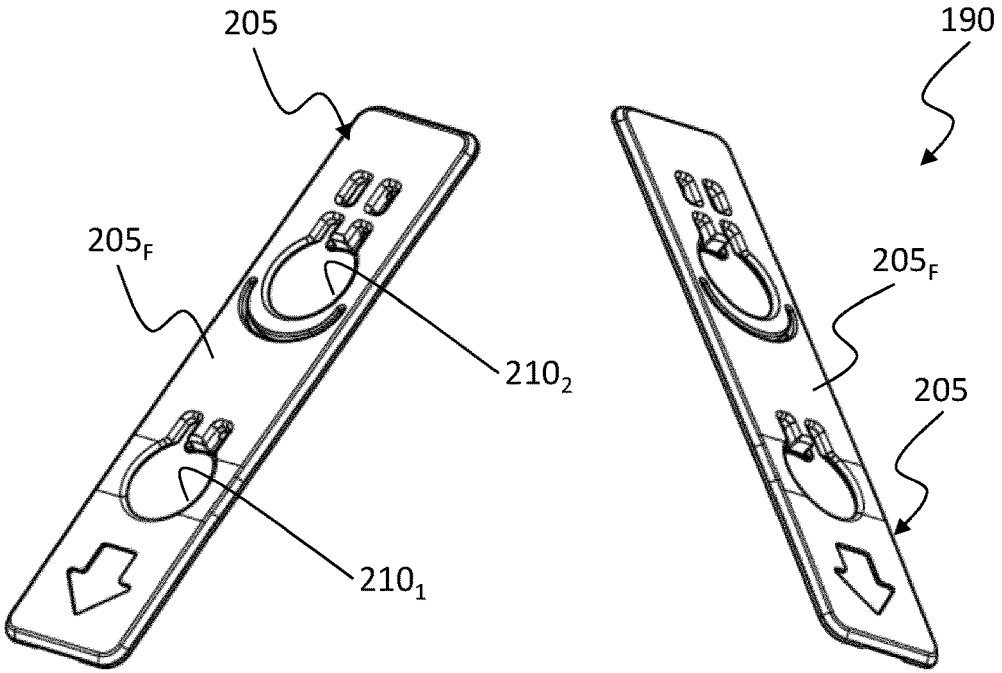
FIG. 2A and FIGS. 2B-2C show perspective front and rear views, respectively, of a cover device of the dishwasher of FIGS. 1A-1D according to an embodiment of the present invention.
Figure 2B:
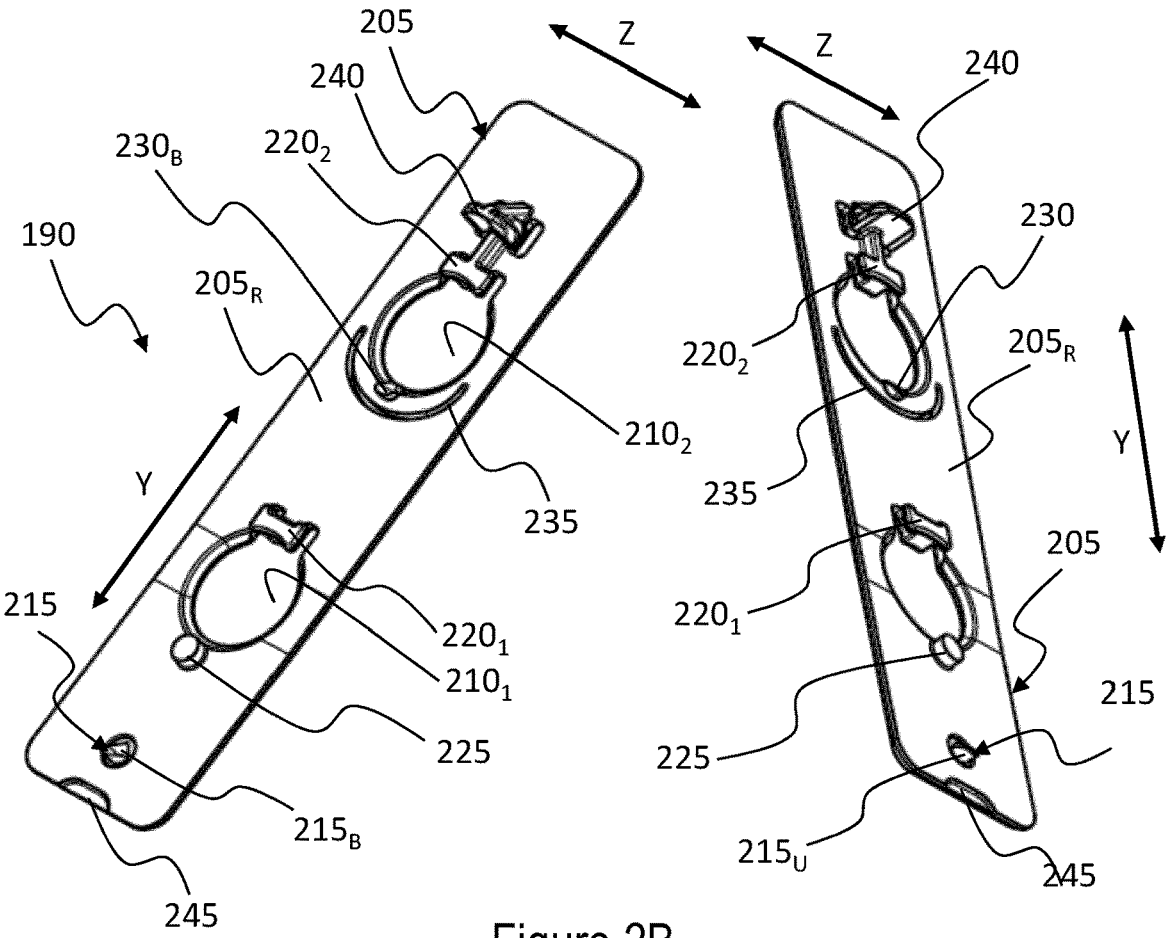
Figure 2C:
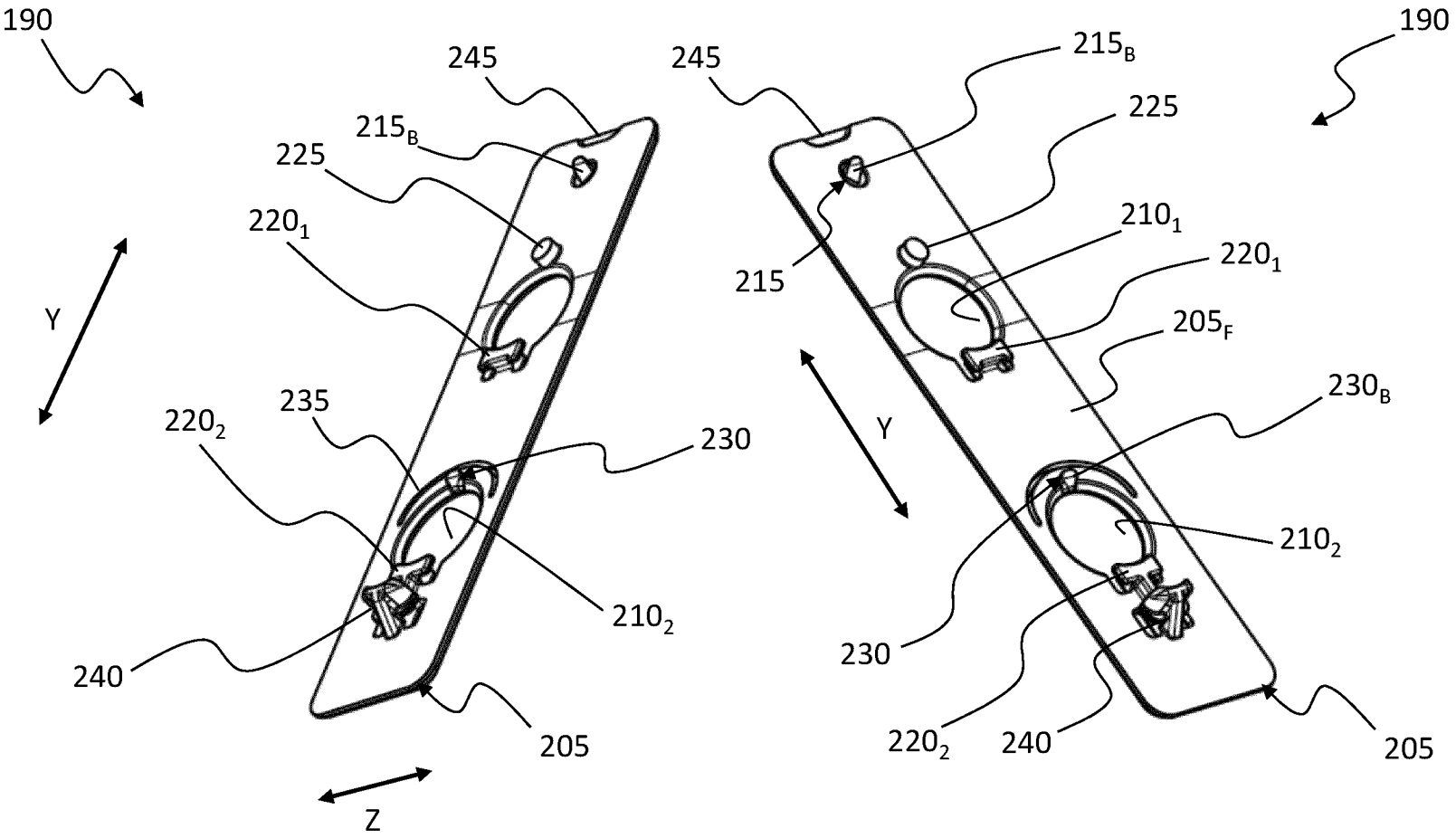

With reference also to FIGS. 2A and FIGS. 2B-2C, they show perspective front and rear views, respectively, of the cover device 190 according to an embodiment of the present invention.

According to an embodiment, the cover device 190 is mountable on the door 125.

According to an embodiment, the cover device 190 is mountable on a side wall of the door 125.

According to an embodiment the cover device 190 is mountable on an external face of the side wall of the door 125 (in the example at issue, the cover device being mounted on the external face of the side wall of the outer door panel $\mathbf{125}_O$ shown in FIG. 1E).

According to an embodiment, the cover device 190 comprises a plate 205 (i.e. a substantially flat and relatively thin piece of material), whereby the cover device 190 does not interfere with the frame 110 during door movement when the cover device 190 is mounted externally to the door 125 (e.g., on the external face of the side wall of the outer door panel $\mathbf{125}_O$).

According to an embodiment, the cover device 190 is rectangular in shape.

According to an embodiment, the cover device 190 is made of a material exhibiting resilience properties, so that the cover device 190 is capable of (slightly) temporarily deforming during sliding thereof (as better discussed in the following). According to an embodiment, the cover device 190 is made of a plastic material.

According to an embodiment, the cover device 190 comprises one or more access holes for allowing the user or the operator to access the access aperture(s) $\mathbf{140}_1$,$\mathbf{140}_2$. According to an embodiment, the cover device 190 comprises two access holes $\mathbf{210}_1$,$\mathbf{210}_2$, the access hole $\mathbf{210}_1$ being for example associated with the lower access aperture $\mathbf{140}_1$ (reason why it will be referred to as lower access hole $\mathbf{210}_1$) and the access hole $\mathbf{210}_2$ being for example associated with the upper access aperture $\mathbf{140}_2$ (reason why it will be referred to as upper access hole $\mathbf{210}_2$).

According to an embodiment, the access holes $\mathbf{210}_1$,$\mathbf{210}_2$ are designed (i.e., shaped and sized) such that, when the cover device 190 is mounted on the door 125 in the opening position, the access holes $\mathbf{210}_1$,$\mathbf{210}_2$ uncover the access apertures $\mathbf{140}_1$,$\mathbf{140}_2$, respectively, whereby the user or the operator is allowed to access the trimming screw 135 through the access holes $\mathbf{210}_1$,$\mathbf{210}_2$ of the cover device 190 and the access apertures $\mathbf{140}_1$,$\mathbf{140}_2$ of the door 125.

According to an embodiment, the access holes $\mathbf{210}_1$,$\mathbf{210}_2$ are essentially circular in shape, e.g. in order to match the shape of the access apertures $\mathbf{140}_1$,$\mathbf{140}_2$.

According to an embodiment, the cover device 190 comprises an engaging member 215, such as an engaging tooth. According to an embodiment, the engaging tooth 215 is configured to engage respective engaging regions or portions of the door 125 in the opening and closing positions of the cover device 190. As better discussed in the following, according to an embodiment, the engaging tooth 215 is configured to engage the engaging hole $\mathbf{140}_{1E}$ of the outer door panel $\mathbf{125}_O$ when the cover device 190 is in the opening position (the engaging hole $\mathbf{140}_{1E}$ thus acting as engaging region or portion for the engaging tooth 215 in the opening position of the cover device 190), and a bottom of the lower access aperture $\mathbf{140}_1$ when the cover device 190 is in the closing position (the lower access aperture $\mathbf{140}_1$, e.g. the bottom of the lower access aperture $\mathbf{140}_1$, thus acting as engaging region or portion for the engaging tooth 215 in the closing position of the cover device 190).

According to an embodiment, the engaging tooth 215 is provided, along the vertical axis Y (considering the orientation of use of the cover device 190, i.e. when it is mounted on the door 125), below the access hole $\mathbf{210}_1$, at a distance from it substantially corresponding to the distance between the engaging hole $\mathbf{140}_{1E}$ and the bottom of the access aperture $\mathbf{140}_1$. According to an embodiment, the engaging tooth 215 protrudes orthogonally to plate 205 from a surface (hereinafter, rear surface) $\mathbf{205}_R$ of the plate 205 that, in use, faces the external face of the side wall of the outer door panel $\mathbf{125}_O$, the rear surface $\mathbf{205}_R$ being opposite to a surface (hereinafter, front surface) $\mathbf{205}_F$ of the cover device 190 that, in use, is visible by the user.

According to an embodiment, as visible in the figure, the engaging tooth 215 comprises a beveled edge $\mathbf{215}_B$ facing the access holes $\mathbf{210}_1$,$\mathbf{210}_2$, and an upright edge $\mathbf{215}_U$ opposite the beveled edge $\mathbf{215}_B$. As better discussed in the following, the beveled edge $\mathbf{215}_B$ promotes disengaging of the engaging tooth 215 from the engaging hole $\mathbf{140}_{1E}$ whereas the upright edge $\mathbf{215}_U$ determines the engaging of the engaging tooth 215 at the bottom of the lower access aperture $\mathbf{140}_1$.

According to an embodiment, the cover device 190 comprises one or more frictional members for providing a frictional coupling between the cover device 190 and the door 125 (e.g., between the cover device 190 and the outer door panel $\mathbf{125}_O$).

According to an embodiment, the frictional member(s) comprise a sliding shoe $\mathbf{220}_1$ associated with the lower access hole $\mathbf{210}_1$ (reason why it will be referred to also as lower sliding shoe $\mathbf{220}_1$).

According to an embodiment, lower the sliding shoe $\mathbf{220}_1$ is provided at a top of the lower access hole $\mathbf{210}_1$, so as to be essentially at the open end (i.e., at the bottom) of the lower guiding aperture $\mathbf{140}_{1G}$ when the cover device 190 is in the opening position. According to an embodiment, the lower sliding shoe $\mathbf{220}_1$ is designed (i.e., shaped and sized)

to be coupled and retained by friction within the edges of the lower guiding aperture $140_{1G}$ when no external force is applied to the cover device 190, and to frictionally slide within the lower guiding aperture $140_{1G}$ when an external force (higher than a frictional force between the lower sliding shoe $220_1$ and the edges of the lower guiding aperture $140_{1G}$) is applied to the cover device 190. According to an embodiment, the lower sliding shoe $220_1$ extends from the rear surface $205_R$ of the plate 205, e.g. substantially orthogonally thereto. According to an embodiment, the lower sliding shoe $220_1$ extends from the rear surface $205_R$ of the plate 205 to such an extent that it does not interfere with the trimming screw 135 during sliding thereof.

Although the lower sliding shoe $220_1$ may be omitted in basic embodiments, the lower sliding shoe $220_1$ may advantageously provide a backup coupling function between the cover device 190 and the outer door panel $125_O$ (e.g., in case of break or damage of the engaging tooth 215).

According to an embodiment, the frictional member(s) comprise a sliding shoe $220_2$ associated with the upper access hole $210_2$ (reason why it will be referred to also as upper sliding shoe $220_2$).

According to an embodiment, the upper sliding shoe $220_2$ is provided at a top of the upper access hole $210_2$, so as to be essentially at the open end (i.e., at the bottom) of the upper guiding aperture $140_{2G}$ when the cover device 190 is in the opening position. According to an embodiment, the upper sliding shoe $220_2$ is designed (i.e., shaped and sized) to be coupled and retained by friction within the edges of the upper guiding aperture $140_{2G}$ when no external force is applied to the cover device 190, and to frictionally slide within the upper guiding aperture $140_{2G}$ when an external force (higher than a frictional force between the upper sliding shoe $220_2$ and the edges of the upper guiding aperture $140_{2G}$) is applied to the cover device 190. According to an embodiment, the upper sliding shoe $220_2$ extends from the rear surface $205_R$ of the plate 205, e.g. substantially orthogonally thereto. According to an embodiment, the upper sliding shoe $220_2$ extends from the rear surface $205_R$ of the plate 205 to such an extent that it does not interfere with the trimming screw 135 during sliding thereof.

Although the upper sliding shoe $220_2$ may be omitted in basic embodiments, the upper sliding shoe $220_2$ may advantageously provide a backup coupling function between the cover device 190 and the outer door panel $125_O$ (e.g., in case of break or damage of an interception element, discussed in the following).

According to an embodiment, the cover device 190 comprises one or more reinforcing members for reinforcing the coupling between the cover device 190 and the door 125 (e.g., between the cover device 190 and the outer door panel $125_O$).

According to an embodiment, the reinforcing element(s) comprise a reinforcing pin 225. According to an embodiment, the reinforcing pin 225 is provided at a bottom of the lower access hole $210_1$, the reinforcing pin 225 being for example opposite to the lower sliding shoe $220_1$ along the vertical axis Y. According to an embodiment, the reinforcing pin 225 is designed (i.e., shaped and sized) to abut against the bottom of the lower access aperture $140_1$ when the cover device 190 is in the opening position. According to an embodiment, the reinforcing pin 225 extends from the rear surface $205_R$ of the plate 205, e.g. substantially orthogonally thereto. According to an embodiment, the reinforcing pin 225 extends from the rear surface $205_R$ of the plate 205 to such an extent that it does not interfere with the trimming screw 135 during sliding thereof.

Although the reinforcing pin 225 may be omitted in basic embodiments, the reinforcing pin 225 may advantageously provide, in the opening position of the cover device 190, a backup coupling function between the cover device 190 and the outer door panel $125_O$ in case of break or damage of the engaging tooth 215.

According to an embodiment, the cover device 190 comprises an anti-release member for preventing the cover device 190 from being easily (and, hence, accidentally) decoupled from the door 125 (e.g., from the outer door panel $125_O$).

According to an embodiment, the anti-release member comprises an anti-release tooth 230. According to an embodiment, the anti-release tooth 230 is provided at a bottom of the upper access hole $210_2$. According to an embodiment, the anti-release tooth is designed (i.e., shaped and sized) to abut against the bottom of the upper access aperture $140_2$ when the cover device 190 is in the opening position. According to an embodiment, the anti-release tooth 230 extends from the rear surface $205_R$ of the plate 205, e.g. substantially orthogonally thereto. According to an embodiment, the anti-release tooth 230 extends from the rear surface $205_R$ of the plate 205 to such an extent that it does not interfere with the trimming screw 135 during sliding thereof.

According to an embodiment, as visible in the figure, the anti-release tooth 230 is similar in structure to the engaging tooth 215. According to an embodiment, the anti-release tooth 230 comprises a beveled edge $230_B$. According to an embodiment, the beveled edge $230_B$ faces the upper access hole $210_2$. According to an embodiment, the anti-release tooth 230 abuts, with an upright edge opposite the beveled edge $230_B$, to the bottom of the upper access aperture $140_2$ when the cover device 190 is in the opening position, so as to prevent the sliding of the cover device 190 (along the backward sliding direction $L_2$, and particularly downwards along the vertical axis Y when the door in in the closed position) when the cover device 190 is in the opening position.

Although the anti-release tooth 230 may be omitted in basic embodiments, the anti-release tooth 230 advantageously prevents the cover device 190 from being easily (and, hence, accidentally) decoupled from the outer door panel $125_O$ when the cover device 190 is in the opening position and a force along the backward direction $L_2$ is accidentally applied to it.

According to an embodiment, the cover device 190 comprises one or more flex members to enhance a resilience of the cover device 190 (particularly, of the plate 205) during bending thereof—indeed, as better discussed in the following, the cover device 190 undergoes a flexure both while automatically sliding from the opening position to the closing position (i.e., for allowing the engaging tooth 215 to disengage from the engaging hole $140_{1E}$), and while being manually slid from the closing position to the opening position (i.e., for allowing the engaging tooth 215 to disengage from the lower access hole $140_1$).

According to an embodiment, the flex member(s) comprise one or more flex grooves to enhance, along the grooves, the resilience of the cover device 190 (particularly, of the plate 205) during bending thereof. According to an embodiment, the flex groove(s), or at least a subset thereof, are provided on the rear surface $205_R$ of the plate 205.

According to an embodiment, the flex groove(s) comprise a rounded (e.g., semicircular) flex groove 235.

According to an embodiment, the flex groove 235 is provided, along the vertical axis Y, below the upper access hole $210_2$. According to an embodiment, the flex groove 235 is provided, along the vertical axis Y, below the anti-release tooth 230.

According to an embodiment, the cover device 190 comprises an interception member 240 for intercepting the trimming screw 135 while moving the door 125 from the closed position to the open position.

According to an embodiment, the interception member 240 extends from the rear surface $205_R$ of the plate 205, e.g. substantially orthogonally thereto. According to an embodiment, the interception member 240 extends from the rear surface $205_R$ of the plate 205 to such an extent that it interferes with the trimming screw 135 during sliding thereof. According to an embodiment, while moving the door 125 from the closed position to the open position, the sliding of the trimming screw 135 (which slides integrally with the sliding member 180) exerts on the interception member 240 a force along the sliding axis L (and particularly, along the forward direction $L_1$), hereinafter forward sliding force, that causes the cover device 190 to move from opening position to the closing position (as mentioned above, the forward sliding force causing the engaging tooth 215 to disengage from the engaging hole $140_{1E}$ and to engage the lower access aperture $140_1$).

As mentioned above, according to an embodiment, the interception member 240 is designed (i.e., shaped and sized) such as to provide also a coupling function at the top of the cover device 190. According to an embodiment, such a coupling function at the top of the cover device 190 comprises a frictional coupling between the interception member 240 (i.e., side edges thereof) and the edges of the upper guiding aperture $140_{2G}$. This allows increasing the coupling between the cover device 190 and the door 125.

According to an embodiment, the cover device 190 comprises one or more grip members for allowing the user or the operator to manually move the cover device 190 from the closing position to the opening position.

According to an embodiment, the grip member(s) comprise a recessed grip 245. According to an embodiment, the recessed grip 245 is formed on the rear surface $205_F$ of the plate, at a bottom of the plate 205 (considering the orientation of use of the cover device illustrated in FIGS. 1A-1D).

The operation of the cover device 190 may be summarized as follows.

When the cover device 190 is mounted on the door 125 in the opening position (FIG. 1A), the access holes $210_1$,$210_2$ uncover the access apertures $140_1$,$140_2$ (so that the user or the operator is allowed to access the trimming screw 135 through the access holes $210_1$,$210_2$ of the cover device 190 and the access apertures $140_1$,$140_2$ of the door 125 in order to fasten the decorative front panel 130 on the door 125 and adjust the vertical position of the decorative front panel 130 with respect to the door 125), the engaging tooth 215 engages (e.g., it is fitted into) the engaging hole $140_{1E}$, the sliding shoe $220_1$,$220_2$ is frictionally coupled to the bottom of the guiding aperture $140_{1G}$,$140_{2G}$, the reinforcing pin 225 abuts against the bottom of the lower access aperture $140_1$, the anti-release tooth 230 abuts against the bottom of the upper access aperture $140_2$ and the interception member 240 is within the upper guiding aperture $140_{2G}$ (the interception member 240 being for example frictionally retained between the edges of the upper guiding aperture $140_{2G}$).

The movement of the door 125 from the closed position to the open position causes a sliding of the sliding system (and, hence, of the trimming screw 135) along the sliding axis L, in the forward direction $L_1$. When the door 125 is in a predetermined position (hereinafter, interception position) between the closed and open position, the trimming screw 135 is intercepted (while sliding) by the interception member 240 (FIG. 1B). According to an embodiment, the interception position corresponds to a about a 60-70-degree rotation angle of the door 125 with respect to the vertical axis Y.

The subsequent movement of the door 125 from the interception position to the open position (FIG. 1C) causes the trimming screw 135 to apply a forward sliding force to the interception member 240 (the forward sliding force acting along the sliding axis L, in the forward direction $L_1$) that allows the cover device 190 to (slightly) temporarily deform at the flex groove 235 and the engaging tooth 215 to disengage from the engaging hole $140_{1E}$. As mentioned above, the disengaging of the engaging tooth 215 from the engaging hole $140_{1E}$ is promoted by the beveled edge $215_B$, and particularly by the direction of the beveled edge $215_B$ with respect to the forward direction $L_1$. After disengaging of the engaging tooth 215 from the engaging hole $140_{1E}$, the forward sliding force applied on the interception member 240 by the trimming screw 135 (due to its sliding) determines the sliding of the cover device 190 through the guiding apertures $140_{1G}$,$140_{2G}$ (particularly, the sliding shoe $220_1$,$220_2$ frictionally slides from the bottom of the guiding aperture $140_{1G}$,$140_{2G}$ in the forward direction $L_1$ and the interception member 240 frictional slides within the upper guiding aperture $140_{2G}$ in the forward direction $L_1$).

When the door 125 is in the open position (FIG. 1C), the interception member 240 is essentially at the end of the upper guiding aperture $140_{2G}$, the engaging tooth 215 is the bottom of the lower access aperture $140_1$, and the plate 205 (i.e., the solid parts thereof) cover the access apertures $140_1$,$140_2$. This corresponds to the closing position of the cover device 190, which prevents the user or the operator (or, even worse, a kid or a baby) from accidentally inserting his/her fingers through the access aperture, and reaching the sliding system (which could cause injury, such as cut or squashing).

Therefore, according to an embodiment, the cover device 190 is configured to automatically move from the opening position to the closing position in response to an initial movement of the door 125 from the closed position to the open position (the initial movement of the door being for example, although not necessarily, the very first door movement performed after the installation of the decorative front panel 130).

The automatic movement of the cover device from the opening position to the closing position allows avoiding to rely on the user or the operator to cover the access apertures.

In the closing position of the cover device 190, the moving of the cover device 190 back to the opening position is prevented by the engaging tooth 215 (particularly, by the upright edge $215_U$ thereof) abutting against the bottom of lower the access aperture $140_1$ and by frictional coupling provided by the sliding shoes $220_1$,$220_2$ and by the interception member 240. Moreover, the movement of the door 125 from the open position to the closed position, which determines the trimming screw 135 to move, along the sliding axis L, in the backward direction $L_2$ does not affect the cover device 190 (indeed, the trimming screw 135, while moving in the backward direction $L_2$ gets away from the interception member 240) whereby the cover device 190 stably takes the closing position for any subsequent door movement, unless the user or the operator need to move it to the opening position for accessing the trimming screw 135 (as discussed here below). Therefore, thanks to the engaging between the engaging tooth 215 and the lower the access aperture $140_1$ (and preferably to the frictional coupling provided by the sliding shoes $220_1$,$220_2$ and by the interception member 240), the cover device 190 is maintained in the closing position at each door movement following the initial door movement.

According to an embodiment, the cover device 190 is configured to be manually moved from the closing position to the opening position (e.g., for adjusting the vertical position of the decorative front panel 130 on the door 125 and/or for disassembling the decorative front panel 130 from the door 125).

According to an embodiment, the cover device 190 is configured to be manually moved from the closing position to the opening position when the door is, along the sliding axis L, between the closed position and a partially-open position. According to an embodiment, the partially-open position corresponds to a distance greater than a predetermined distance, and particularly to such distance (along the sliding axis L) between the interception member 240 and the trimming screw 135 that the sliding of the cover device 190 (and, hence, of the interception member 240) in the backward direction $L_2$ is not hindered by the trimming screw 135. According to an embodiment, the partially-open position of the door 125 at which the cover device 190 can be moved from the closing position to the opening position corresponds to about a 30-40-degree rotation angle of the door 125 with respect to the vertical axis Y. Otherwise stated, according to an embodiment, the cover device 190 is configured to be manually moved from the closing position to the opening position when the door is rotated with respect to the rotation axis by at least one predetermined rotation angle, e.g. about a 50-60-degree rotation angle with respect to the rotation axis.

According to an embodiment, in order to move the cover device 190 from the closing position to the opening position, the user or the operator has to grasp with his/her fingers the recessed grip 245 and concurrently apply a pulling force (i.e., a force essentially orthogonal to the sliding axis L) and a sliding force in the backward direction $L_2$ (hereinafter, backward sliding force). In the example illustrated in FIG. 1C in which the cover device 190 is moved from the closing position to the opening position when the door 125 in the closed position, the backward sliding force is a downwards force. As should be understood, the pulling force determines the bending of the plate 205 and hence the disengaging of the engaging pin 215 from the bottom of the lower access aperture $140_1$, and the backward sliding force determines the sliding of the cover device 190 along the guiding apertures $140_{1G}$,$140_{2G}$ in the backward direction $L_2$ (until the engaging pin 215 engages the engaging hole $140_{1E}$).

Figure 3A:
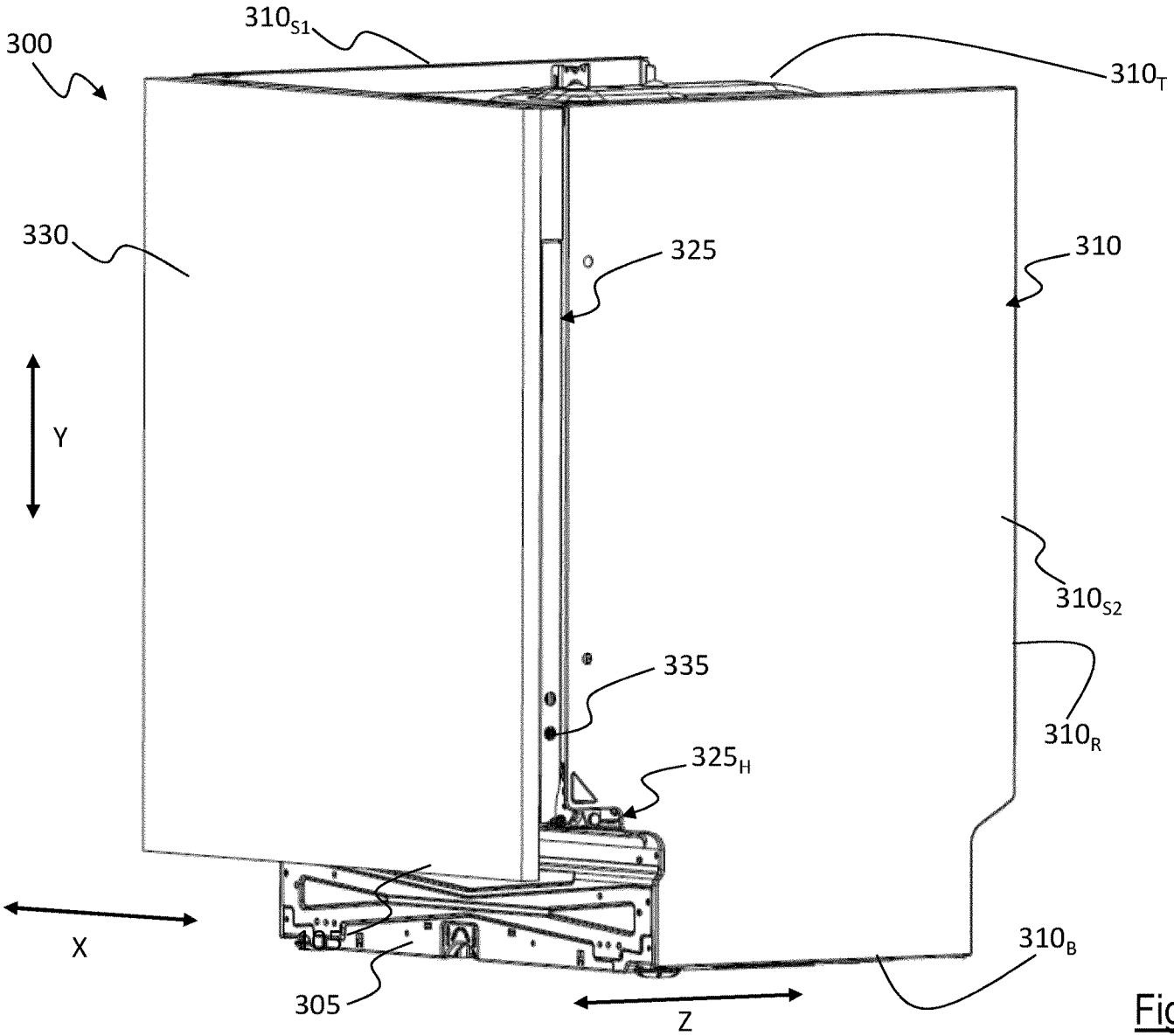
FIGS. 3A-3C show a dishwasher in different operative positions, according to an embodiment of the present invention.
Figure 3B:
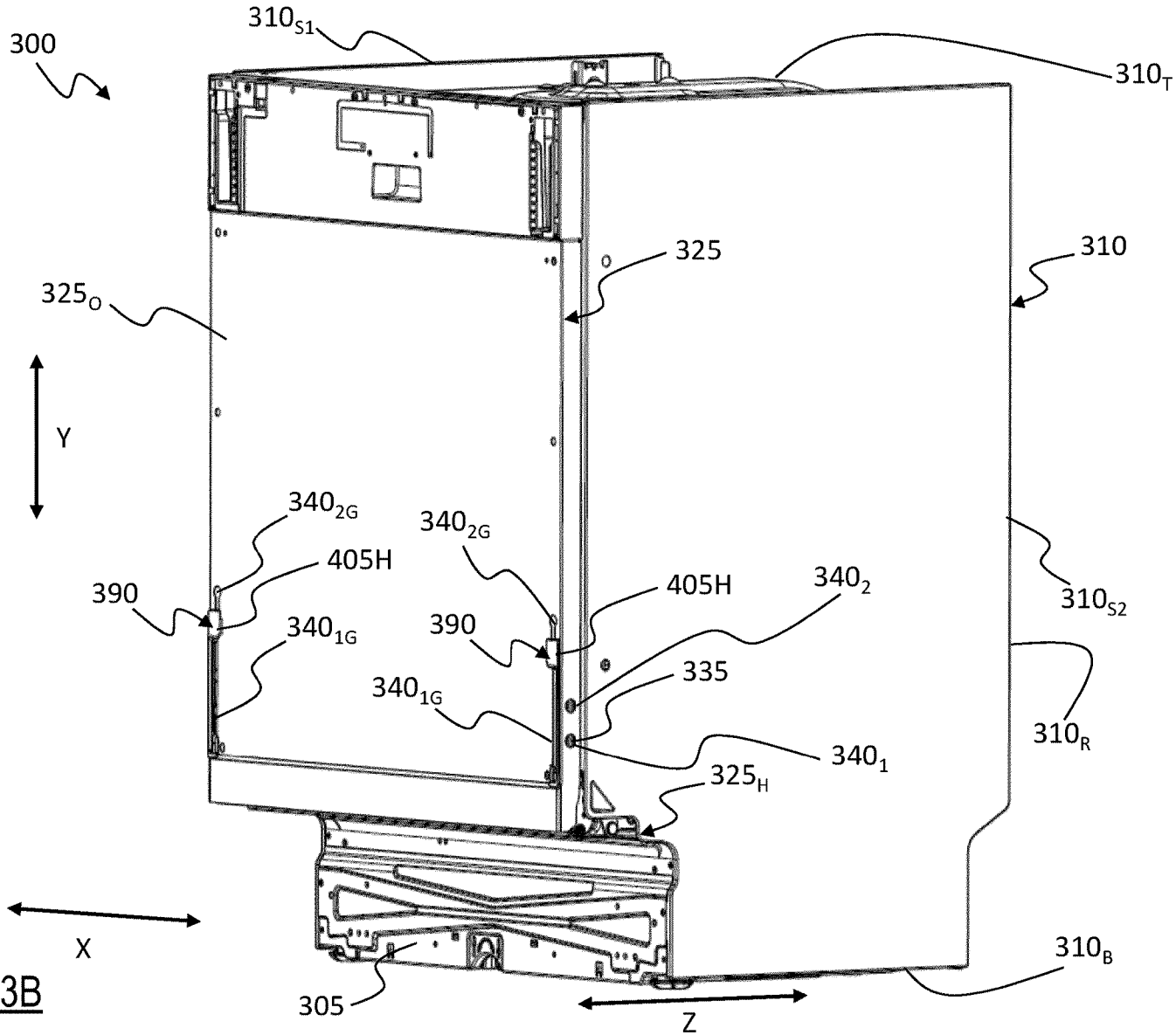
Figure 3C:
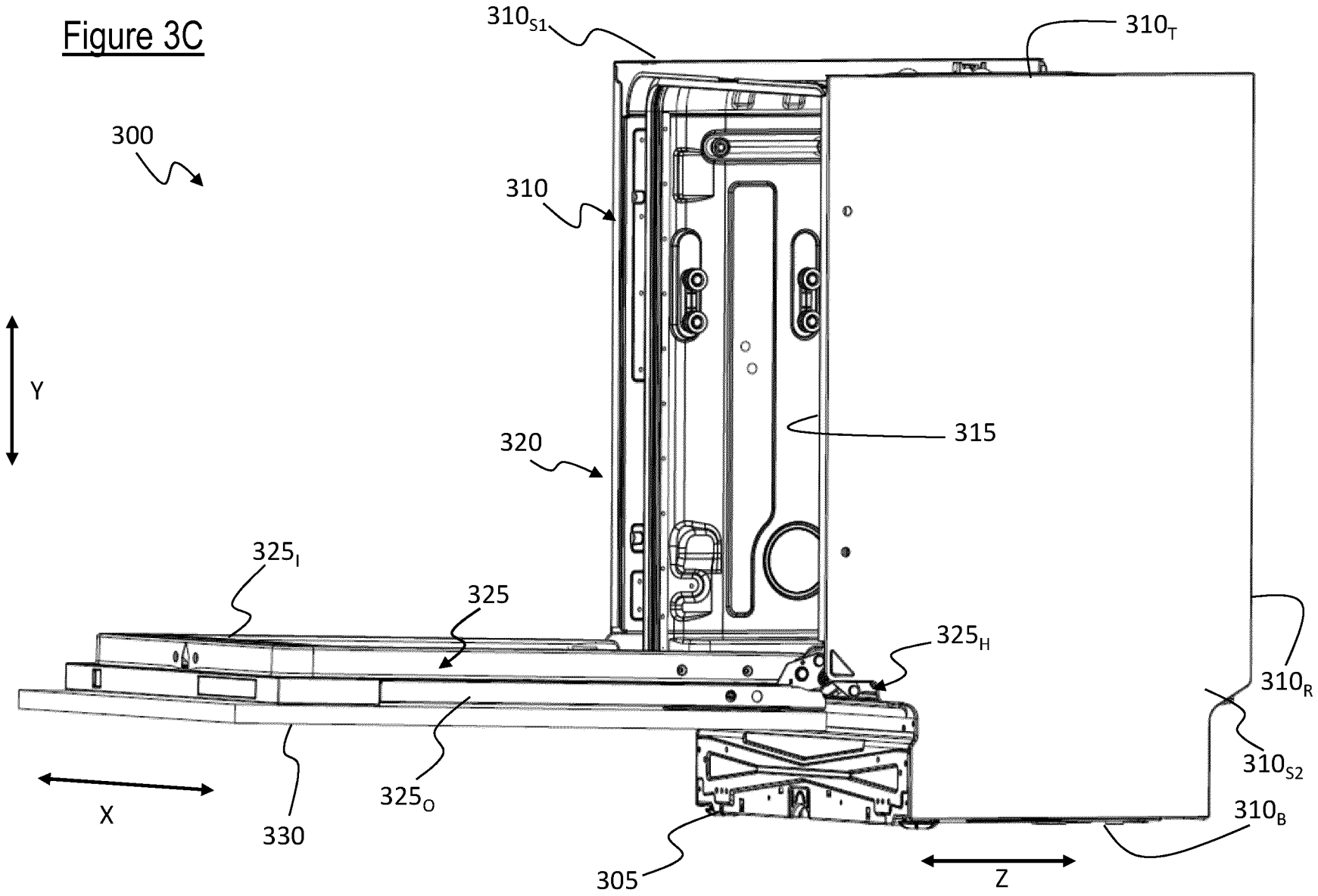

With reference to FIGS. 3A-3C, they show a dishwasher 300 in different operative positions, according to an embodiment of the present invention.

According to an embodiment, the dishwasher 300 is structurally similar to the dishwasher 100, whereby same or similar components are denoted by corresponding references and their explanation will not be repeated when deemed not necessary.

According to an embodiment the dishwasher 300 comprises a base 305 for resting the dishwasher 300 on a support surface (not shown in the figures), e.g. parallel to the plane X-Z), such as a floor or a support surface of a suitable niche of a piece of furniture wherein the dishwasher 300 can be installed.

According to an embodiment, the dishwasher 300 comprises a (e.g., parallelepiped shaped) body or frame 310.

According to an embodiment, the frame 310 defines a (e.g., hollow) treatment chamber 315 for items to be washed.

According to an embodiment, the dishwasher 300 comprises, within the treatment chamber 315, one or more pullout racks (not shown in the figures) for inserting the items to be washed into the treatment chamber 315.

According to an embodiment, the frame 310 comprises top $310_T$ and bottom $310_B$ walls parallel to the X-Z plane, a rear wall $310_R$ parallel to the X-Y plane, and two side walls $310_{S1}$,$310_{S2}$ parallel to the Y-Z plane.

According to an embodiment, the frame 310 defines a front load opening 320 parallel to the X-Y plane, and opposite to the rear wall $310_R$ along the transverse axis Z.

According to an embodiment, the dishwasher 300 comprises a door assembly.

According to an embodiment, the door assembly comprises a door 325 for selectively opening the front load opening 320, and hence for selectively accessing the treatment chamber 315.

According to an embodiment, the door 325 is movable (e.g., rotatable) between closed and open positions.

The door 325 is exemplary shown in the closed position in FIGS. 3A and 3B and in the open position in FIG. 3C.

According to an embodiment, the door 325 comprises an outer door panel $325_O$ and an inner door panel $325_I$, structurally and functionally similar to the outer door panel $125_O$ and the inner door panel $125_I$.

According to an embodiment, the door assembly comprises a door hinge $325_H$ for rotationally coupling the door 325 to the base 305, so that the door 325 can rotate with respect to the frame 310 about a horizontal rotation axis (raised from the floor), parallel to the longitudinal axis X. According to an embodiment, the door 325 can be moved from the closed position to the open position by a drop-down movement, and from the open position to the closed position by a pull-up movement. According to an embodiment, the door hinge $325_H$, not shown in these figures, is analogous to the door hinge $125_H$.

According to an embodiment, the dishwasher 300 is a fully-integrated dishwasher or a semi-integrated dishwasher, whereby upon dishwasher installation, the door 325 may be coupled to a decorative front panel 330 so as to be completely or almost completely covered by it. According to an embodiment, the decorative front panel 130, which is not part of the dishwasher 300, has same appearance as, or it is at least coordinated with, the other pieces of the furniture, the decorative front panel 330 being for example made of wood. FIGS. 3A and 3C show the dishwasher 300 with the decorative front panel 330, and FIG. 3B shows the dishwasher 300 without the decorative front panel 330.

According to an embodiment, the door hinge $325_H$ comprises a fastening system for fastening the decorative front panel 330 on the door 325 and for adjusting the vertical position of the decorative front panel 330 with respect to the door 325. According to an embodiment, the fastening system, not shown in these figures, is analogous to the fastening system illustrated in FIGS. 1F-1H.

For the purposes of the present disclosure, the fastening system comprises an actuatable or adjusting member, for example a trimming screw 335 (e.g., made of a metal material or other rigid material) adapted to be screwed/unscrewed or rotated by the user or the operator.

According to an embodiment, the door 325 comprises one or more access apertures for allowing the user or the operator to access and actuate (e.g., by insertion of a screw driver or wrench) the trimming screw 335.

According to an embodiment, the access aperture(s) are provided at the outer door panel $325_O$, e.g. at a lower end region of a side thereof that is visible by the user when the door 325 is not in the closed position.

According to an embodiment, the outer door panel $325_O$, comprises two access apertures $340_1$,$340_2$. According to an embodiment, the access apertures $340_1$,$340_2$ are aligned to each other along the vertical axis Y, so as to define a lower access aperture $340_1$ and an upper access aperture $340_2$ (taking the orientation of use of the dishwasher 300 as a reference).

According to an embodiment, each access aperture $340_1$, $340_2$ is designed (i.e., shaped and sized) to allow the user to access and actuate the trimming screw 335 in respective positions of the door 325 (as discussed in the foregoing, the trimming screw 335 moves in response to door movement, whereby the trimming screw 335 may be accessed through the lower access aperture $340_1$ or through the upper access aperture $340_2$ depending on a position of the door 325).

According to an embodiment, each access apertures $340_1$, $340_2$ is circular (or substantially circular) in shape, and is large enough to allow the user or the operator to access and actuate (e.g., by insertion of a screw driver or wrench) the trimming screw 335.

According to an embodiment, the door 325 comprises, e.g. on a front wall of the outer door panel $325_O$, one or more guiding apertures. According to an embodiment, the door 325 comprises two guiding apertures $340_{1G}$,$340_{2G}$ (visible in FIGS. 3B and 4B). According to an embodiment, the guiding apertures $340_{1G}$,$340_{2G}$ are aligned to each other along the vertical axis Y. According to an embodiment, each guiding aperture $340_{1G}$,$340_{2G}$ extends and are aligned along the vertical axis Y (reason why they will be referred to also as lower guiding aperture $340_{1G}$ and upper access aperture $340_2$), each guiding aperture $340_{1G}$,$340_{2G}$ being for example elongated in shape. According to an embodiment, the guiding apertures $340_{1G}$,$340_{2G}$ correspond to the elongated slots that, in some conventional dishwashers, are provided on the front wall of the outer door panel $325_O$ for assembling and adjusting the decorative front panel (according to an embodiment, such elongated slots are provided also in the dishwasher 100, although not discussed as being not relevant for the understanding of FIGS. 1A-2B embodiment).

According to an embodiment, the guiding apertures $340_{1G}$,$340_{2G}$ are designed to guide movement/sliding of the cover device during movement/sliding of the decorative front panel 330 with respect to the door 325 (so as to cover the access apertures $340_1$,$340_2$, as better discussed in the following). As better discussed in the following, the guiding apertures $340_{1G}$,$340_{2G}$ allow guiding the cover device between the opening and closing positions.

According to an embodiment, the door hinge $325_H$ comprises a sliding system for allowing the decorative front panel 330 to slide with respect to the door 325 during door movement. According to an embodiment, the sliding system (not shown in these figures) is analogous to the sliding system illustrated in FIGS. 1F-1H, the sliding system being configured to slide, along the sliding axis L, in the forward direction $L_1$ when the door 325 is moved from the closed position to the open position and in the backward direction $L_2$ when the door 325 is moved from the open position to the closed position.

As discussed in the foregoing, the sliding system is coupleable to the decorative front panel 330 such that, when coupled to the decorative front panel 330, a sliding of the sliding system during door movement causes the decorative front panel 330 to slide with respect to the door 325 along the sliding axis L, thus avoiding interferences of the decorative front panel 330 with any furniture baseboard (not shown).

As discussed in the foregoing, the fastening system is mechanically coupled to the sliding system so as to slide integrally to the sliding system during door movement, the trimming screw 335 being thus movable along the sliding axis L with the sliding of the sliding system (and, hence, with the door movement).

The dishwasher 300 comprises a cover device 390 (partially visible in FIG. 3B) mountable on the door assembly and configured to take, when mounted on the door assembly, the opening position (in which the cover device 390 leaves the access apertures $340_1$,$340_2$ of the door 325 uncovered), and the closing position (in which the cover device 390 covers at least partially, preferably completely, the access apertures $340_1$,$340_2$ of the door 325).

Similarly to the cover device 190, the cover device 390 is configured to mechanically cooperate/interact with the sliding system so as to automatically move from the opening position to the closing position in response to the sliding of the sliding system.

According to an embodiment, the cover device 390 is mounted on the door 325.

According to an embodiment, the cover device 390 is mounted internally to the door 325. According to an embodiment, the cover device 390 is mounted internally to the outer door panel $325_O$.

Figure 4A:
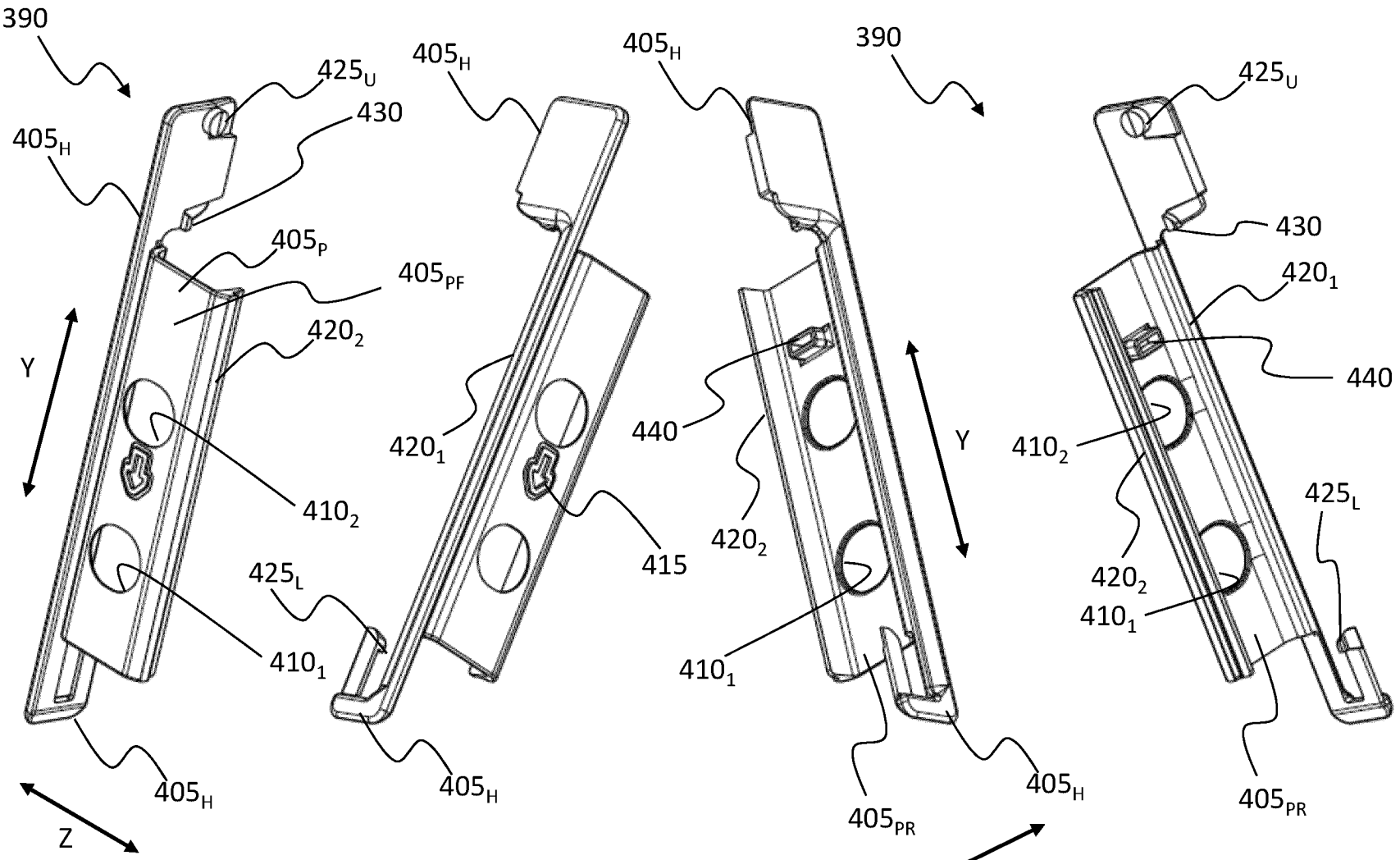
FIG. 4A shows perspective front and rear views of a cover device of the dishwasher of FIGS. 3A and 3B according to an embodiment of the present invention.
Figure 4B:
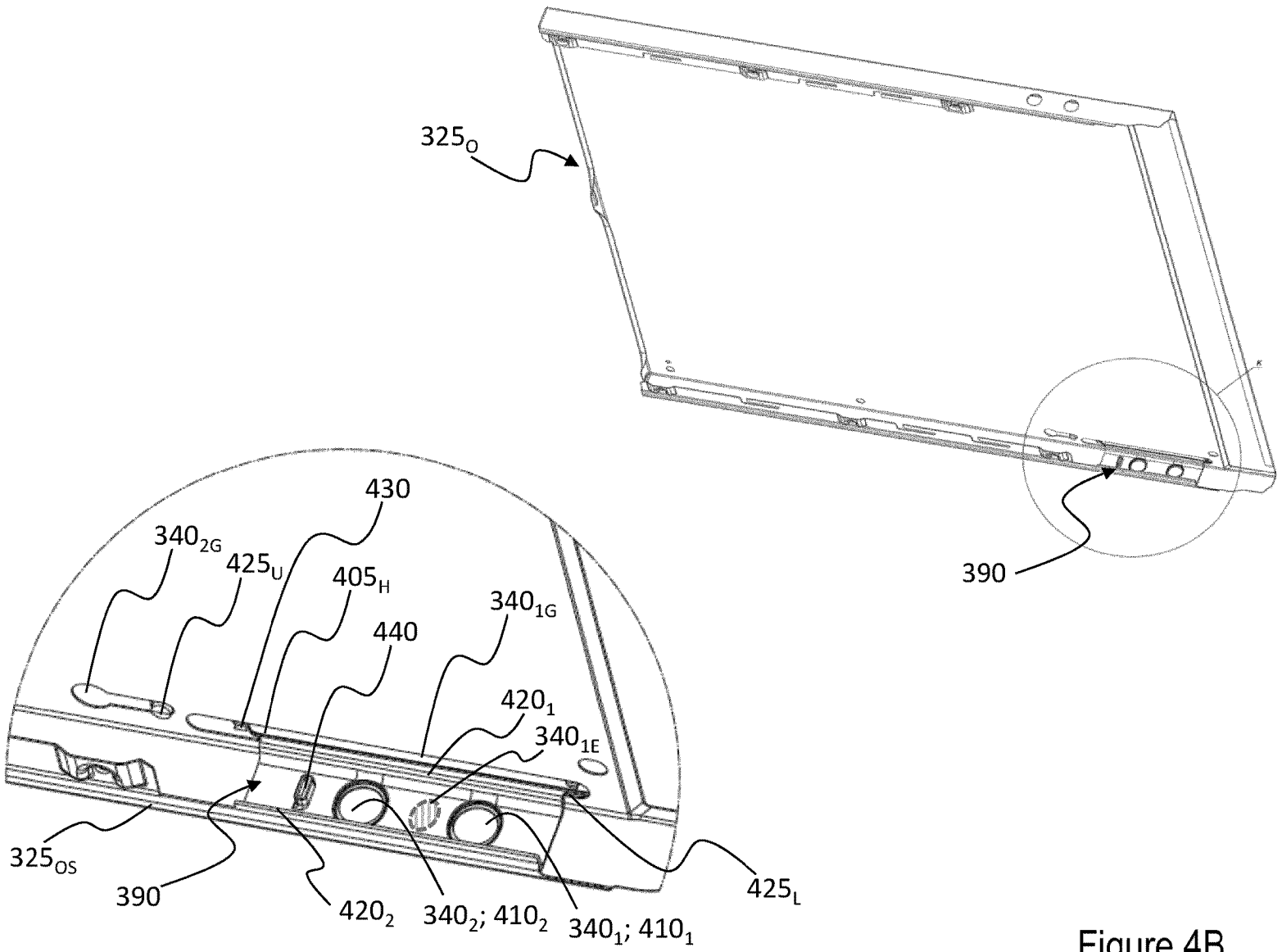
FIG. 4B shows the cover device of FIG. 4A mounted on a door of the dishwasher, according to an embodiment of the present invention.

According to an embodiment the cover device 390 is mounted on an internal face of the side wall of the outer door panel $325_O$ and on an internal side of a front wall of the outer door panel $325_O$ (the external and internal sides of the front wall of the outer door panel $325_O$ being visible in FIGS. 3B and 4B, respectively).

With reference also to FIG. 4A, it shows perspective front (on the left) and rear (on the right) views of the cover device 390 according to an embodiment of the present invention. For ease of description, FIG. 4A will be discussed jointly to FIG. 4B, which shows the cover device 390 mounted on the outer door panel $325_O$ of the dishwasher 300.

According to an embodiment, the cover device 390 is made of a material exhibiting resilience properties, so that the cover device 390 is capable of (slightly) temporarily deforming during sliding thereof (as better discussed in the following). According to an embodiment, the cover device 390 is made of a plastic material.

According to an embodiment, the cover device 390 comprises a plate $405_P$ (e.g., rectangular in shape) configured to rest on the internal face of the side wall of the outer door panel $325_O$.

According to an embodiment, the cover device 390 comprises, e.g. on the plate $405_P$, one or more access holes for allowing the user or the operator to access the access aperture(s). According to an embodiment, the cover device 390 comprises, e.g. on the plate $405_P$, two access holes for allowing the user or the operator to access the access apertures $340_1$,$340_2$. According to an embodiment, the cover device 390 comprises a lower access hole $410_1$ associated with the lower access aperture $340_1$, and an upper access hole $410_2$ associated with the upper access aperture $340_2$.

According to an embodiment, the access holes $410_1$,$410_2$ are designed (i.e., shaped and sized) such that, when the cover device 390 is mounted on the door 325 in the opening position, the access holes $410_1$,$410_2$ uncover the access apertures $340_1$,340, respectively (so that the user or the operator is allowed to access the trimming screw 335 through the access holes $410_1$,$410_2$ of the cover device 390 and the access apertures $340_1$,$340_2$ of the door 325).

According to an embodiment, the access holes $410_1$,$410_2$ are essentially circular in shape, e.g. in order to match the shape of the access apertures $340_1$,$340_2$.

According to an embodiment, the cover device 390 comprises an engaging member 415, such as an engaging protrusion. According to an embodiment, the engaging protrusion 415 is configured to engage respective engaging regions or portions of the door 325 in the opening and closing positions of the cover device 390. As better discussed in the following, according to an embodiment, the engaging protrusion 415 is configured to frictionally engage the internal face of the outer door panel $325_O$ when the cover device 390 is in the opening position, and edges of the upper access aperture $340_2$ when the cover device 390 is in the closing position (the upper access aperture $340_2$, e.g. the edges of the upper access aperture $340_2$, thus acting as engaging region or portion for the engaging protrusion 415 in the closing position of the cover device 390).

According to an embodiment, the engaging protrusion 415 is provided, along the vertical axis Y (considering the orientation of use of the cover device 390, i.e. when it is mounted on the door 325), below the upper access hole $410_2$. The region of the internal face of the side wall of the outer door panel $325_O$ between the lower $340_1$ and upper $340_2$ access apertures (indicated in FIG. 4B by the number reference $340_{1E}$) thus acts as engaging region or portion for the engaging protrusion 415 in the opening position of the cover device 390. According to an embodiment, the engaging protrusion 415 protrudes orthogonally to plate $405_P$ from a front surface $405_{PF}$ thereof that, in use, faces the internal face of the side wall of the outer door panel $325_O$, the front surface $405_{PF}$ being opposite to a rear surface $405_{PR}$.

According to an embodiment, the engaging protrusion 415 has a circular (or substantially circular) or semicircular (or substantially semicircular) shape, so as to substantially matches the edges of the upper access aperture $340_2$ when the cover device 390 is in the closing position.

According to an embodiment, the cover device 390 comprises one or more frictional members for providing a frictional coupling between the cover device 390 and the door 325 (e.g., between the cover device 390 and the outer door panel $325_O$).

According to an embodiment, the frictional member(s) comprise two sliding brackets $420_1$,$420_2$ provided at respective sides of the plate $405_P$ (hereinafter referred to also as left $420_1$ and right $420_2$ sliding brackets).

According to an embodiment, the right sliding bracket $420_1$ is designed (i.e., shaped and sized) to be coupled and retained by friction within an inwardly rounded profile $325_{OS}$ of the side wall of the outer door panel $325_O$ (visible in FIG. 4B). As will be understood from the following discussion, the inwardly rounded profile $325_{OS}$ also acts as a guiding member for guiding the cover device 390 within or along it.

According to an embodiment, the sliding bracket $420_2$ is designed (i.e., shaped and sized) to be abut and slide with friction on the internal face of the front wall of the outer door panel $325_O$ (see FIG. 4B).

According to an embodiment, each sliding bracket $420_1$, $420_2$ extends, from the respective side of the plate $405_P$, substantially orthogonally to the plate $405_P$, so that the sliding brackets $420_1$,$420_2$ and the plate $405_P$ substantially define a C-shape profile.

According to an embodiment, the sliding brackets $420_1$, $420_2$ are formed in a single piece with the plate $405_P$.

Although the sliding brackets $420_1$,$420_2$ may be omitted in basic embodiments, the sliding brackets $420_1$,$420_2$ may advantageously provide a backup coupling function between the cover device 390 and the door 325 (e.g., in case of break or damage of the engaging protrusion 415).

According to an embodiment, the cover device 390 comprises one or more reinforcing members for reinforcing the coupling between the cover device 390 and the door 325.

According to an embodiment, the reinforcing members are configured to cooperate with the front wall of the outer door panel $325_O$.

According to an embodiment, the reinforcing members are configured to cooperate with the guiding apertures $340_{1G}$,$340_{2G}$.

According to an embodiment, the reinforcing member(s) comprise an overhanging member $405_H$ projecting from the plate $405_P$ (particularly, from the left sliding bracket $420_1$) and configured to be coupled to the guiding apertures $340_1$,$340_2$ (or at least one thereof). According to an embodiment, the overhanging member $405_H$ projects from the left sliding bracket $420_1$, the overhanging member $405_H$ being for example made in a single piece with the left sliding bracket $420_1$.

According to an embodiment, the reinforcing member(s) comprise, e.g. at an upper portion of the overhanging member $405_H$, a reinforcing pin $425_U$ (hereinafter, upper reinforcing pin). According to an embodiment, the upper reinforcing pin $425_U$ extends from the upper portion of the overhanging member $405_H$, e.g. substantially orthogonally thereto.

According to an embodiment, the upper reinforcing pin $425_U$ is designed (i.e., shaped and sized) to abut against the bottom of the upper access aperture $340_2$ when the cover device 390 is in the opening position (as visible in FIG. 4B).

Although the upper reinforcing pin $425_U$ may be omitted in basic embodiments, the upper reinforcing pin $425_U$ may advantageously provide, in the opening position of the cover device 390, a backup coupling function between the cover device 390 and the door 325 in case of break or damage of a lower reinforcing pin (discussed here below).

According to an embodiment, the reinforcing member(s) comprise, at a lower portion of the of the overhanging member $405_H$, a reinforcing pin $425_L$ (hereinafter, lower reinforcing pin). According to an embodiment, the lower reinforcing pin $425_L$, extends from the lower portion of the overhanging member $405_H$, e.g. substantially orthogonally thereto.

According to an embodiment, the lower reinforcing pin $425_L$ is designed (i.e., shaped and sized) to abut against the bottom of the lower access aperture $340_1$ when the cover device 390 is in the opening position (as visible in FIG. 4B).

Although the lower reinforcing pin $425_L$ may be omitted in basic embodiments, the lower reinforcing pin $425_L$ may advantageously provide, in the opening position of the cover device 390, a backup coupling function between the cover device 390 and the door 325 in case of break or damage of the upper reinforcing pin $425_U$.

According to an embodiment, the overhanging member $405_H$ is configured to resiliently deform with respect to a rest condition (shown in FIG. 4A). According to an embodiment, the overhanging member $405_H$ is configured to resiliently deform with respect to the rest condition to allow a snap mounting of the cover device 390 to the door 325. According to an embodiment, as better discussed in the following, the upper portion of the overhanging member $405_H$ is configured to resiliently deform with respect to the rest condition so as to allow the upper portion of the overhanging member $405_H$ to pass through the lower access aperture $340_1$ and to stably adhere to the external face of the front side of the outer door panel $325_O$ (see FIGS. 3B and 4B) due to the elastic force exerted by the overhanging member $405_H$ tending to elastically return to its rest position.

According to an embodiment, the cover device 390 comprises an end stroke member for stopping a sliding of the cover device 390 when the cover device 390 has reached the closing position.

According to an embodiment, the end stroke member comprises an end stroke tooth 430. According to an embodiment, the end stroke tooth 430 is provided at a bottom of the upper portion of the overhanging member $405_H$, the end stroke tooth 430 for example extending substantially orthogonally to the upper portion of the overhanging member $405_H$ (the end stroke tooth 430 for example extending along the transverse direction Z). According to an embodiment, the end stroke tooth 430 is designed (i.e., shaped and sized) to abut against the top of the lower access aperture $340_1$ when the cover device 390 is in the closing position.

Although the end stroke tooth 430 may be omitted in basic embodiments, the end stroke tooth 430 advantageously prevents the cover device 390 from sliding (in the forward direction $L_1$) beyond the closing position, otherwise it could be difficult to move the cover device 390 from the closing position back to the opening position.

According to an embodiment, the cover device 390 comprises an interception member 440 for intercepting the trimming screw 335 while moving the door 325 from the closed position to the open position.

According to an embodiment, the interception member 440 extends from the rear surface $405_{PR}$ of the plate $405_P$, e.g. substantially orthogonally thereto. According to an embodiment, the interception member 440 extends from the rear surface $405_{PR}$ of the plate $405_P$ to such an extent that it interferes with the trimming screw 335 during sliding thereof. According to an embodiment, while moving the door 325 from the closed position to the open position, the sliding of the trimming screw 335 (which slides integrally with the sliding member) exerts on the interception member 440 a forward sliding force (along the sliding axis L, in the forward direction $L_1$) that causes the cover device 390 to move from opening position to the closing position (as mentioned above, the forward sliding force causing the engaging protrusion 415 to slide along (thus disengaging from) the internal face of the side wall of the outer door panel $325_O$ and to engage the upper access aperture $340_2$).

According to an embodiment, the cover device 390 comprises one or more grip members for allowing the user or the operator to manually move the cover device 390 from the closing position to the opening position.

According to an embodiment, the grip member(s) are provided on the engaging protrusion 415, so as to be accessible by the user or the operator through the upper access aperture $340_2$ when the cover device 390 is in the closing position. According to an embodiment, the grip member(s) comprise a relief portion of the engaging protrusion 415. In the exemplary illustrated embodiment, the relief portion of the engaging protrusion 415 that advantageously acts as a grip member has the shape of an arrow (which is advantageously directed in the backward sliding).

The operation of the cover device 390 may be summarized as follows.

When the cover device 390 is mounted on the door 125 in the opening position (FIG. 4B), the access holes $410_1$,$410_2$ uncover the access apertures $340_1$,$340_2$, the engaging protrusion 415 frictionally engages the engaging region $340_{1E}$ of the internal face of the side wall of the outer door panel $325_O$ between the lower $340_1$ and upper $340_2$ access apertures, the left sliding bracket $420_1$ is coupled and retained by friction within the inwardly rounded profile $325_{OS}$ of the side wall of the outer door panel $325_O$, the right sliding bracket $420_2$ abuts on the internal face of the front wall of the outer door panel $325_O$, the upper portion of the overhanging member $405_H$ is snap fitted and adheres to the external face of the front side of the outer door panel $325_O$ (see also FIG. 3B), the upper reinforcing pin $425_U$ abuts against the bottom of the upper access aperture $340_2$, the end stroke tooth 430 is within the upper guiding aperture $340_{2G}$, and the lower reinforcing pin $425_L$ abuts against the bottom of the lower access aperture $340_1$.

Similarly to the cover device 190, the movement of the door 325 from the closed position to the open position causes a sliding of the sliding system (and, hence, of the trimming screw 335) along the sliding axis L, in the forward direction $L_1$. When the door 325 is in the interception position, the trimming screw 335 is intercepted (while sliding) by the interception member 340 (not shown).

Similarly to the cover device 190, the subsequent movement of the door 325 from the interception position to the open position determines an external force to be applied to the interception member 340 along the sliding axis L (in the forward direction $L_1$) that allows the cover device 190 to slide through the guiding apertures $340_{1G}$,$340_{2G}$.

When the door 325 is in the open position, the end stroke tooth 430 abuts against the top of the upper access aperture $340_2$ and the plate $305_P$ (i.e., the solid parts thereof) covers the access apertures $340_1$,$340_2$. This corresponds to the closing position of the cover device 390.

Therefore, according to an embodiment, the cover device 390 is configured to automatically move from the opening position to the closing position in response to an initial movement of the door 325 from the closed position to the open position (the initial movement of the door being for example, although not necessarily, the very first door movement performed after the installation of the decorative front panel 330).

The automatic movement of the cover device from the opening position to the closing position allows avoiding to rely on the user or the operator to cover the access apertures.

In the closing position of the cover device 390, the moving of the cover device 390 back to the opening position is prevented by the engaging protrusion 415 fitted within the upper access aperture $340_2$ and by the frictional coupling provided by the sliding brackets $420_1$,$420_2$. Moreover, the movement of the door 325 from the open position to the closed position, which determines the trimming screw 335 to move, along the sliding axis L, in the backward direction $L_2$ does not affect the cover device 390 (indeed, the trimming screw 335, while moving in the backward direction $L_2$ gets away from the interception member 440) whereby the cover device 390 stably takes the closing position for any subsequent door movement, unless the user or the operator needs to move it to the opening position for accessing the trimming screw 335 (as discussed here below). Therefore, thanks to the engaging between the engaging protrusion 415 and the upper access aperture $340_2$ (and preferably to the frictional coupling provided by the sliding brackets $420_1$, $420_2$), the cover device 390 is maintained in the closing position at each door movement following the initial door movement.

According to an embodiment, the cover device 390 is configured to be manually moved from the closing position to the opening position (e.g., for adjusting the vertical position of the decorative front panel 330 on the door 325 and/or for disassembling the decorative front panel 330 from the door 325).

According to an embodiment, the cover device 390 is configured to be manually moved from the closing position to the opening position when the door is, along the sliding axis L, between the closed position and a partially-open position. According to an embodiment, the partially-open position corresponds to a distance greater than a predetermined distance, and particularly to such a distance (along the sliding axis L) between the interception member 440 and the trimming screw 335 that the sliding of the cover device 390 (and, hence, of the interception member 440) in the backward direction $L_2$ is not hindered by the trimming screw 335. According to an embodiment, the partially-open position of the door 325 at which the cover device 390 can be moved from the closing position to the opening position corresponds to about a 30-40-degree rotation angle of the door 325 with respect to the vertical axis Y. Otherwise stated, according to an embodiment, the cover device 390 is configured to be manually moved from the closing position to the opening position when the door is rotated with respect to the rotation axis by at least one predetermined rotation angle, e.g. about a 50-60-degree rotation angle with respect to the rotation axis.

According to an embodiment, in order to move the cover device 390 from the closing position to the opening position, the user or the operator has to access with his/her fingers the grip member on (e.g., the relief portion of) the engaging protrusion 415 and apply a pushing force (i.e., a force essentially orthogonal to the sliding axis L, opposite to the pulling force of FIGS. 1A-2B embodiment) and a backward sliding force in the backward direction $L_2$. When the door 325 in the closed position, the backwards sliding force is a downwards force. As should be understood, the pushing force determines the bending of the plate $\mathbf{305}_P$ and hence the disengaging of the engaging protrusion 415 from the upper access aperture $\mathbf{340}_2$, and the backward sliding force determines the sliding of the cover device 390 along the guiding apertures $\mathbf{340}_{1G}$,$\mathbf{340}_{2G}$ in the backward direction $L_2$ (until the upper reinforcing pin $\mathbf{425}_U$ abuts on the bottom of the upper guiding aperture $\mathbf{340}_{2G}$ and the lower reinforcing pin $\mathbf{425}_L$ abuts on the bottom of the lower guiding aperture $\mathbf{340}_{1G}$).

Figure 4C:
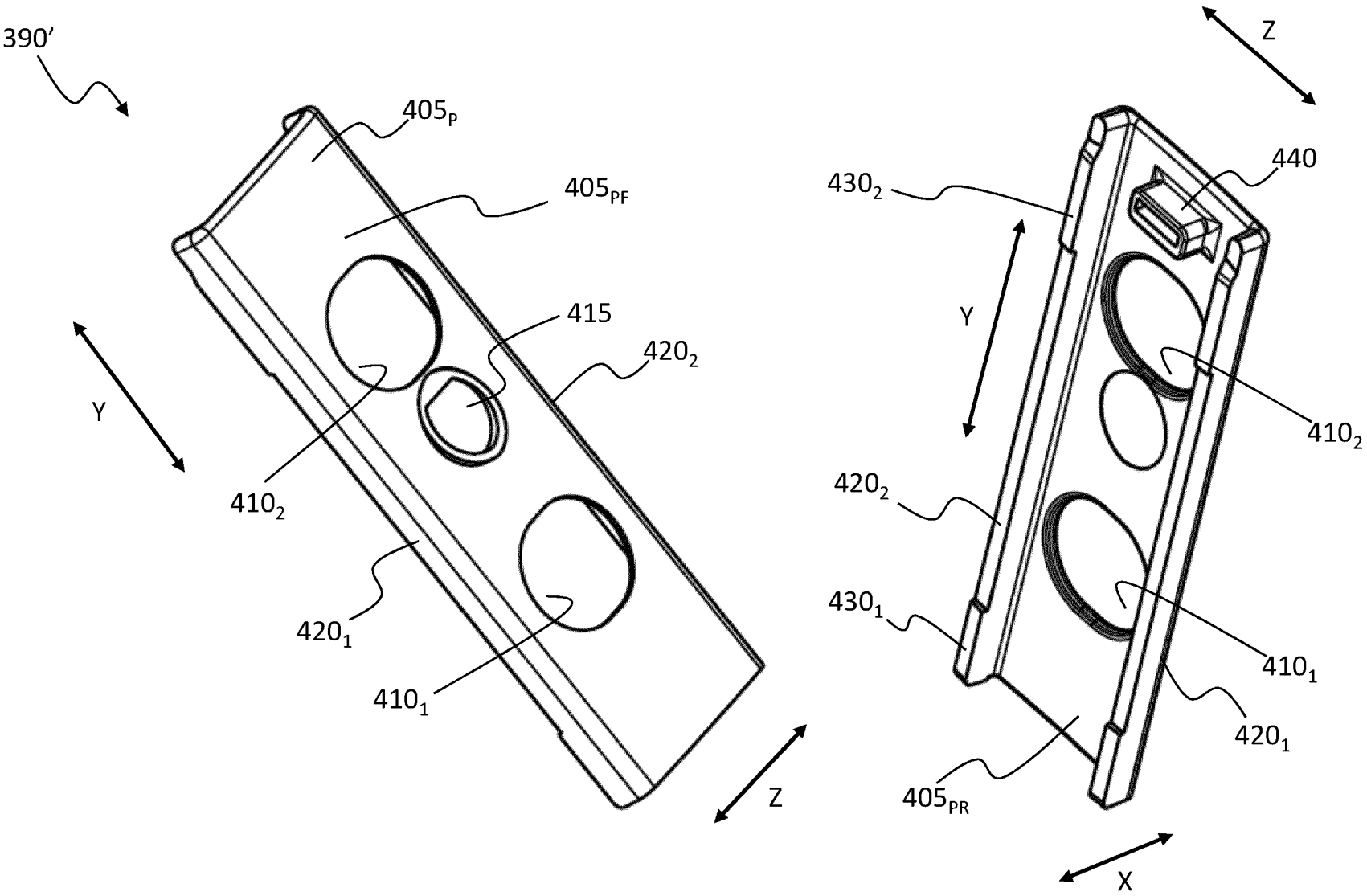
FIG. 4C shows perspective front and rear views of a variant of the cover device of FIG. 4A according to an embodiment of the present invention.
Figure 4D:
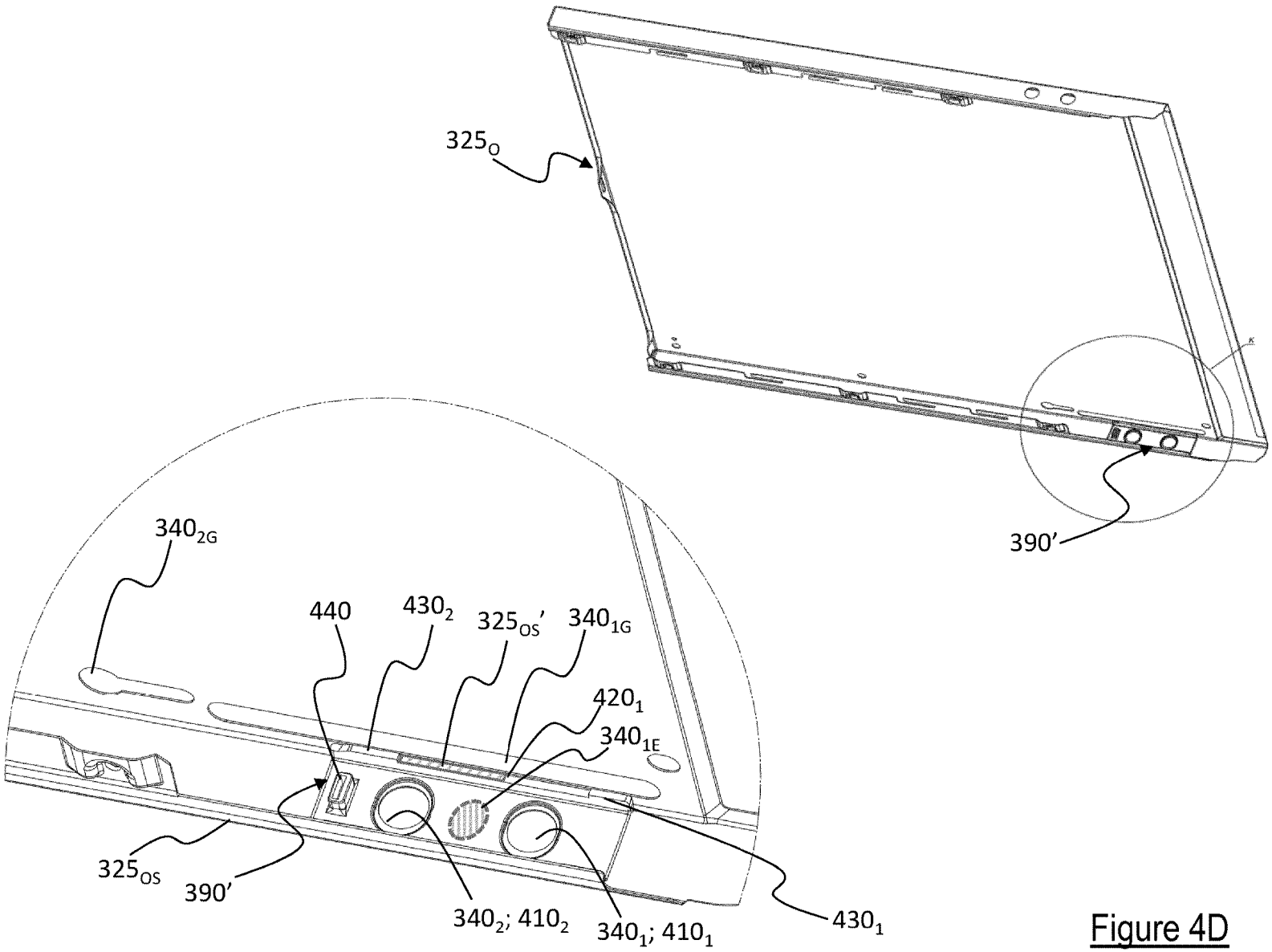
FIG. 4D shows the cover device of FIG. 4C mounted on a door of the dishwasher, according to an embodiment of the present invention.

FIG. 4C shows perspective front (on the left) and rear (on the right) views of a variant of the cover device 390 according to an embodiment of the present invention, the variant of the cover device 390 being denoted by the reference 390'. For ease of description, FIG. 4C will be discussed jointly to FIG. 4D, which shows the cover device 390' mounted on a variant of the outer door panel $\mathbf{325}_O$ of the dishwasher 300 (the variant of the outer door panel $\mathbf{325}_O$ of the dishwasher 300 being denoted by the reference $\mathbf{325}_O$').

The cover device 390' is very similar to the cover device 390, i.e. it comprises the plate $\mathbf{405}_P$ having front $\mathbf{405}_{PF}$ and rear $\mathbf{405}_{PR}$ surfaces and configured to rest (with its front surface $\mathbf{405}_{PF}$) on the internal face of the side wall of the outer door panel $\mathbf{325}_O$', the lower $\mathbf{410}_1$ and upper $\mathbf{410}_2$ access holes, the engaging protrusion 415 configured to frictionally engage the engaging region $\mathbf{340}_{1E}$ of the internal face of the side wall of the outer door panel $\mathbf{325}_O$' when the cover device 390' is in the opening position and the edges of the upper access aperture $\mathbf{340}_2$ when the cover device 390' is in the closing position, the interception member 440 for intercepting the trimming screw 335 while moving the door from the closed position to the open position, and the left $\mathbf{420}_1$ and right $\mathbf{420}_2$ sliding brackets.

Differently from the cover device 390, no overhanging member is provided in the cover device 390'. Indeed, according to an embodiment, the cover device 390' is configured to be coupled and retained at both left $\mathbf{420}_1$ and right $\mathbf{420}_2$ sliding brackets. In order to achieve it, according to an embodiment, the outer door panel $\mathbf{325}_O$' comprises, in addition to the inwardly rounded profile $\mathbf{325}_{OS}$, a cantilevered plate $\mathbf{325}_{OS}$' provided, along the transverse direction Z, at an opposite side with respect to the inwardly rounded profile $\mathbf{325}_{OS}$. As will be understood from the following discussion, the cantilevered plate $\mathbf{325}_{OS}$' also acts as a guiding member for guiding the cover device 390' within or along it.

According to an embodiment, the left sliding bracket $\mathbf{420}_1$ is coupled and retained (and slide with friction) within the inwardly rounded profile $\mathbf{325}_{OS}$ (as for the cover 390) and the right sliding bracket $\mathbf{420}_2$ is coupled and retained (and slide with friction) between the cantilevered plate $\mathbf{325}_{OS}$' and the portion of the internal face of the side wall of the outer door panel $\mathbf{325}_O$' below it.

According to an embodiment, the cover device 390' comprises one or more end stroke members for stopping a sliding of the cover device 390' when the cover device 390' has reached the closing position and/or the opening position.

According to an embodiment, the end stroke member(s) comprise two end stroke members $\mathbf{430}_1$,$\mathbf{430}_2$ provided, along the vertical direction Y, at respective ends of the right sliding bracket $\mathbf{420}_2$ (reason why they will be referred to also as lower $\mathbf{430}_1$ and upper $\mathbf{430}_2$ end strokes members). According to an embodiment, each end stroke member $\mathbf{430}_1$,$\mathbf{430}_2$ extends from the right sliding bracket $\mathbf{420}_2$, orthogonally thereto (i.e., each end stroke member $\mathbf{430}_1$, $\mathbf{430}_2$ extends from the right sliding bracket $\mathbf{420}_2$ along the longitudinal direction X).

According to an embodiment, the end stroke members $\mathbf{430}_1$,$\mathbf{430}_2$ and the cantilevered plate $\mathbf{325}_{OS}$' are designed (i.e., shaped and sized) such that the cantilevered plate $\mathbf{325}_{OS}$' abuts against the upper end stroke member $\mathbf{430}_2$ when the cover device 390' is in the opening position (as visible in FIG. 4D) and against the lower end stroke member $\mathbf{430}_1$ when the cover device 390' is in the closing position.

The operation of the cover device 390', very similar to the operation of the cover device 390, may be summarized as follows.

When the cover device 390' is mounted on the door 325 in the opening position (FIG. 4D), the access holes $\mathbf{410}_1$, $\mathbf{410}_2$ uncover the access apertures $\mathbf{340}_1$,$\mathbf{340}_2$, the engaging protrusion 415 frictionally engages the engaging region $\mathbf{340}_{1E}$ of the internal face of the side wall of the outer door panel $\mathbf{325}_O$ between the lower $\mathbf{340}_1$ and upper $\mathbf{340}_2$ access apertures, the left sliding bracket $\mathbf{420}_1$ is coupled and retained within the inwardly rounded profile $\mathbf{325}_{OS}$ of the side wall of the outer door panel $\mathbf{325}_O$, the right sliding bracket $\mathbf{420}_2$ is coupled and retained between the cantilevered plate $\mathbf{325}_{OS}$' and the region of the outer door panel $\mathbf{325}_O$' below it, and the cantilevered plate $\mathbf{325}_{OS}$' abuts against the upper end stroke member $\mathbf{430}_2$.

Similarly to the cover device 390, the movement of the door 325 from the closed position to the open position causes a sliding of the sliding system (and, hence, of the trimming screw 335) along the sliding axis L, in the forward direction $L_1$. When the door 325 is in the interception position, the trimming screw 335 is intercepted (while sliding) by the interception member 440 (not shown).

Similarly to the cover device 390, the subsequent movement of the door 325 from the interception position to the open position determines a forward sliding force to be applied to the interception member 340 along the sliding axis L (in the forward direction $L_1$) that allows the cover device 390' to slide.

When the door 325 is in the open position, the cantilevered plate $\mathbf{325}_{OS}$' abuts against the lower end stroke member $\mathbf{430}_1$ and the plate $\mathbf{305}_P$ (i.e., the solid parts thereof) covers the access apertures $\mathbf{340}_1$,$\mathbf{340}_2$. This corresponds to the closing position of the cover device 390'.

Similarly the cover device 390, according to an embodiment, the cover device 390' is configured to be manually moved from the closing position to the opening position by applying a pushing force on the engaging protrusion 415 (which determines the bending of the plate $\mathbf{305}_P$ and hence the disengaging of the engaging protrusion 415 from the upper access aperture $\mathbf{340}_2$) and a backward sliding force in the backward direction $L_2$ (which determines the sliding of the cover device 390' until the cantilevered plate $\mathbf{325}_{OS}$' abuts back against the upper end stroke member $\mathbf{430}_2$).

Figure 5A:
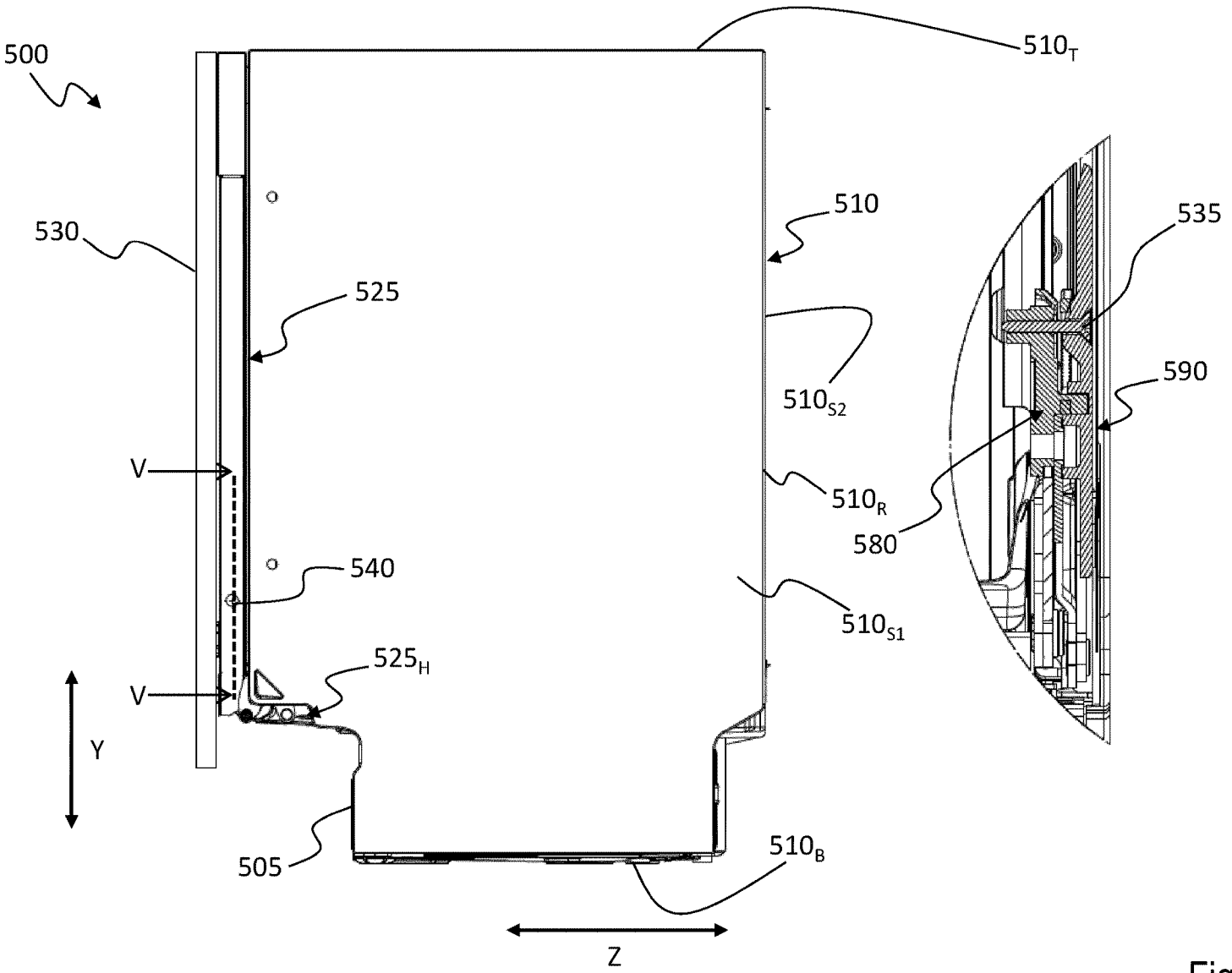
FIGS. 5A-5C show a dishwasher in different operative positions, according to an embodiment of the present invention.
Figure 5B:
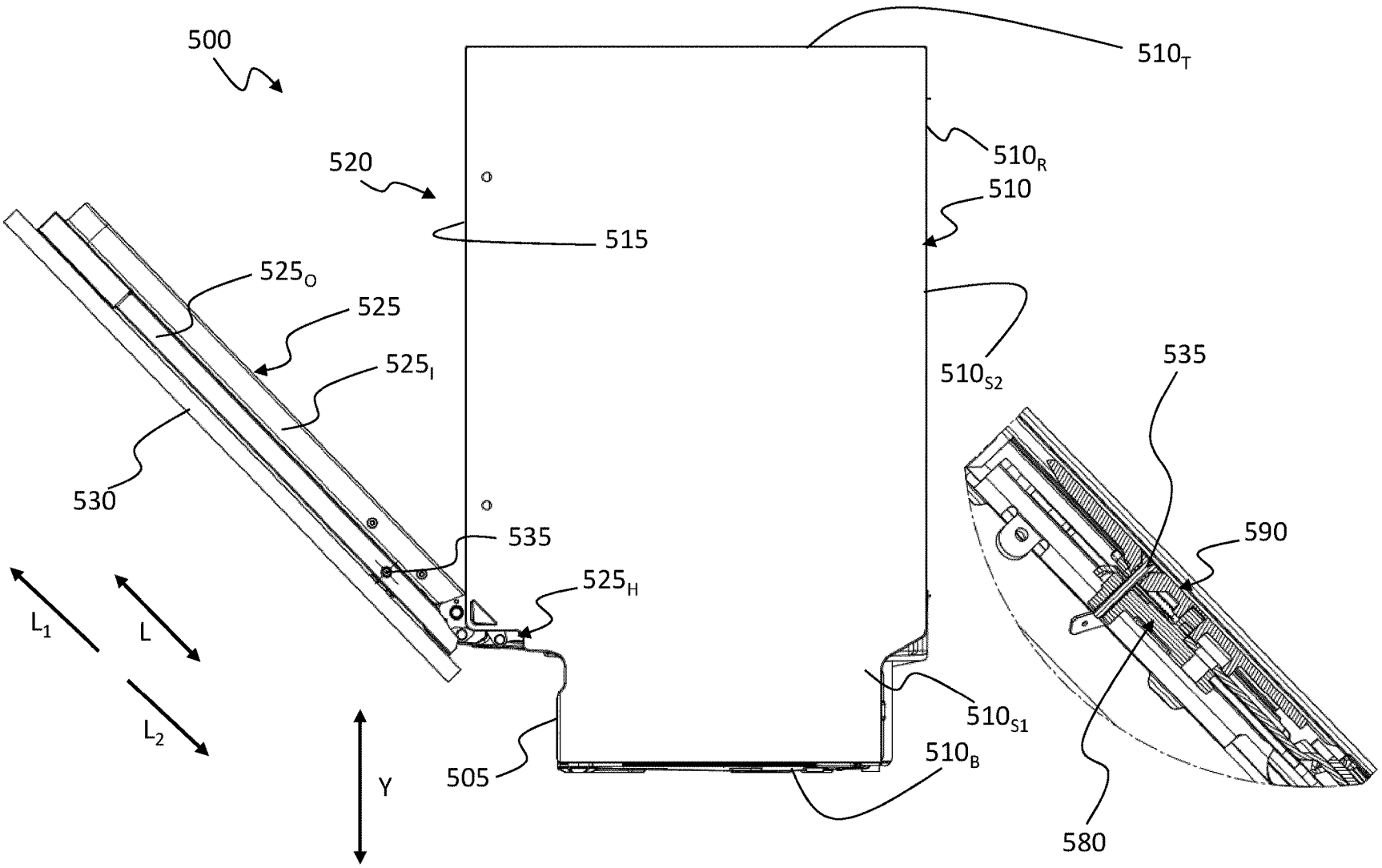
Figure 5C:
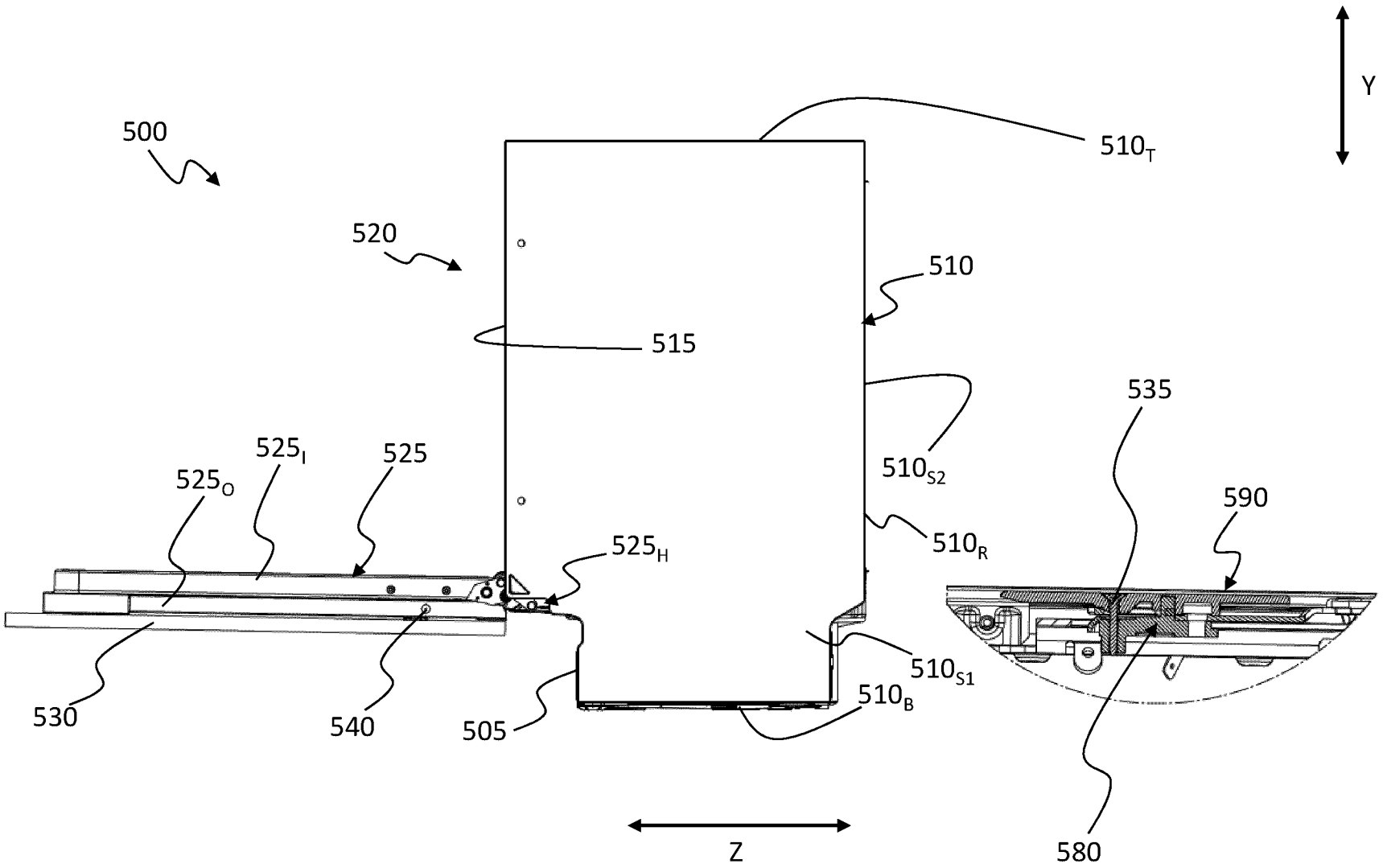

With reference to FIGS. 5A-5C, they show perspective side views of a dishwasher 500 in different operative positions, according to an embodiment of the present invention. Each one of the FIGS. 5A-5C also shows a sectional view of the dishwasher 500 along the V-V sectional axis, each sectional view illustrating a respective interaction between the cover device and a hinge of the dishwasher 500. For ease of description, FIGS. 5A-5C will be discussed jointly to FIG. 5D, which show rear (on the left) and side (on the right) views of a portion of the dishwasher 500 according to an embodiment of the present invention.

According to an embodiment, the dishwasher 500 is structurally similar to the dishwashers 100 and 300, whereby same or similar components are denoted by corresponding references and their explanation will not be repeated when deemed not necessary.

According to an embodiment, the dishwasher 500 comprises a base 505 for resting the dishwasher 500 on a support surface (not shown in the figures), e.g. parallel to the plane X-Z), such as a floor or a support surface of a suitable niche of a piece of furniture wherein the dishwasher 500 can be installed.

According to an embodiment, the dishwasher 500 comprises a (e.g., parallelepiped shaped) body or frame 510.

According to an embodiment, the frame 510 defines a (e.g., hollow) treatment chamber 515 for items to be washed.

According to an embodiment, the frame 510 comprises top $\mathbf{510}_T$ and bottom $\mathbf{510}_B$ walls parallel to the X-Z plane, a rear wall $\mathbf{510}_R$ parallel to the X-Y plane, and two side walls $\mathbf{510}_{S1}$,$\mathbf{510}_{S2}$ parallel to the Y-Z plane.

According to an embodiment, the frame 510 defines a front load opening 520 parallel to the X-Y plane, and opposite to the rear wall $\mathbf{510}_R$ along the transverse axis Z.

According to an embodiment, the dishwasher 500 comprises a door assembly.

According to an embodiment, the door assembly comprises a door 525 for selectively opening the front load opening 520, and hence for selectively accessing the treatment chamber 515.

According to an embodiment, the door 525 is movable (e.g., rotatable) between closed and open positions.

The door 525 is exemplary shown in the closed position in FIG. 5A, in a partially open position in FIG. 5B and in the open position in FIG. 5C.

According to an embodiment, the door 525 comprises an outer door panel $\mathbf{525}_O$ and an inner door panel $\mathbf{525}_I$, structurally and functionally similar to the outer door panels $\mathbf{125}_O$,$\mathbf{325}_O$ and the inner door panels $\mathbf{125}_I$,$\mathbf{325}_O$.

According to an embodiment, the door assembly comprises a door hinge $\mathbf{525}_H$ for rotationally coupling the door 525 to the base 505, so that the door 525 can rotate with respect to the frame 510 about a horizontal rotation axis (raised from the floor), parallel to the longitudinal axis X. According to an embodiment, the door 525 can be moved from the closed position to the open position by a drop-down movement, and from the open position to the closed position by a pull-up movement.

According to an embodiment, the dishwasher 500 is a fully-integrated dishwasher or a semi-integrated dishwasher, whereby upon dishwasher installation, the door 525 may be coupled to a decorative front panel 530 so as to be completely or almost completely covered by it.

According to an embodiment, the door assembly comprises a fastening system for fastening the decorative front panel 530 on the door 525 and for adjusting the vertical position of the decorative front panel 530 with respect to the door 525. According to an embodiment, the fastening system, not shown in these figures, is analogous to the fastening system illustrated in FIGS. 1F-1H (as better discussed in the following).

For the purposes of the present disclosure, the fastening system comprises an actuatable or adjusting member, for example a trimming screw 535 (e.g., made of a metal material or other rigid material) adapted to be screwed/unscrewed or rotated by the user or the operator.

According to an embodiment, the door 525 comprises one or more access apertures for allowing the user or the operator to access and actuate (e.g., by insertion of a screw driver or wrench) the trimming screw 535.

According to an embodiment, the access aperture(s) are provided at the outer door panel $\mathbf{525}_O$, e.g. at a lower end region of a side thereof that is visible by the user when the door 525 is not in the closed position.

According to an embodiment, the outer door panel $\mathbf{325}_O$, comprises a single access aperture 540.

According to an embodiment, the access aperture 540 is designed (i.e., shaped and sized) to allow the user to access and actuate the trimming screw 535 in a predetermined position of the door 525 (as discussed in the foregoing, the trimming screw 535 moves in response to door movement, whereby the trimming screw 535 may be accessed through the access aperture 540 when the door 525 is in the predetermined position).

According to an embodiment, the door assembly comprises a sliding system for allowing the decorative front panel 530 to slide with respect to the door 525 during door movement. According to an embodiment, the sliding system is configured to slide, along the sliding axis L, in the forward direction $L_1$ when the door 525 is moved from the closed position to the open position and in the backward direction $L_2$ when the door 525 is moved from the open position to the closed position.

As discussed in the foregoing, the sliding system is coupleable to the decorative front panel 530 such that, when coupled to the decorative front panel 530, a sliding of the sliding system during door movement causes the decorative front panel 530 to slide with respect to the door 525 along the sliding axis L, thus avoiding interferences of the decorative front panel 530 with any furniture baseboard (not shown).

As discussed in the foregoing, the fastening system is mechanically coupled to the sliding system so as to slide integrally to the sliding system during door movement, the trimming screw 535 being thus movable along the sliding axis L with the sliding of the sliding system (and, hence, with the door movement).

The sliding system is structurally different from the sliding system illustrated in FIGS. 1F-1H (in that, as better discussed in the following, in this embodiment the cover device is configured to be mounted directly on the sliding system).

According to an embodiment, the dishwasher 500 comprises a cover device 590 mountable on the door assembly and configured to take, when mounted on the door assembly, the opening position (in which the cover device 590 leaves the access aperture 540 of the door 525 uncovered), and the closing position (in which the cover device 590 covers at least partially, preferably completely, the access aperture 540 of the door 525).

Similarly to the cover devices 190, 390 and 390', the cover device 590 is configured to mechanically cooperate/interact with the sliding system so as to automatically move from the opening position to the closing position in response to the sliding of the sliding system.

According to an embodiment, the cover device 590 is mounted on the sliding system, whereby the cover device 590 is configured to move from the opening position to closing position when the door 525 is moved from the closed position to the open position, and to move from the closing position to the opening position when the door 525 is moved from the open position back to the closed position.

Figure 5D:
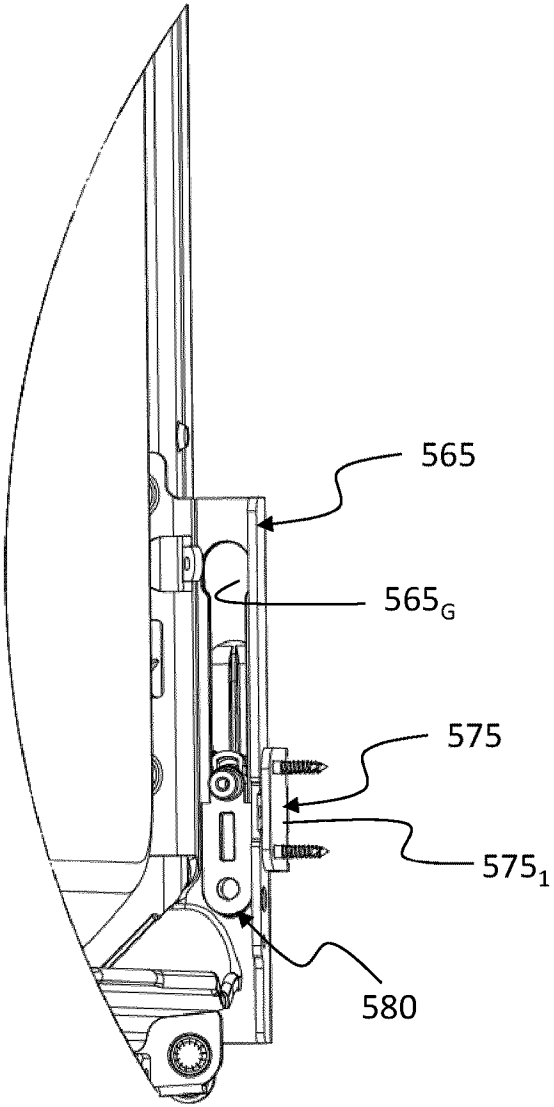
FIG. 5D shows a portion of the dishwasher of FIGS. 5A-5C according to an embodiment of the present invention.
Figure 5D:
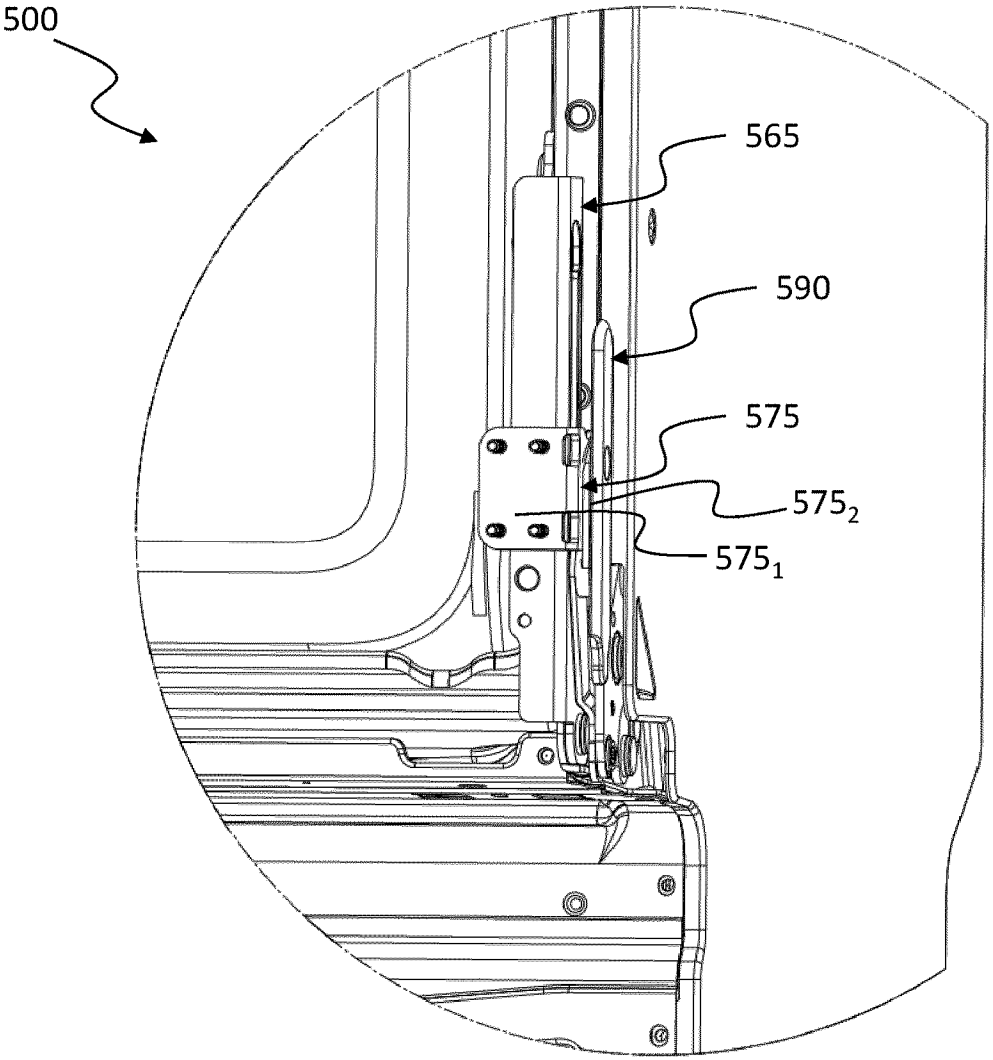
Figure 5E:
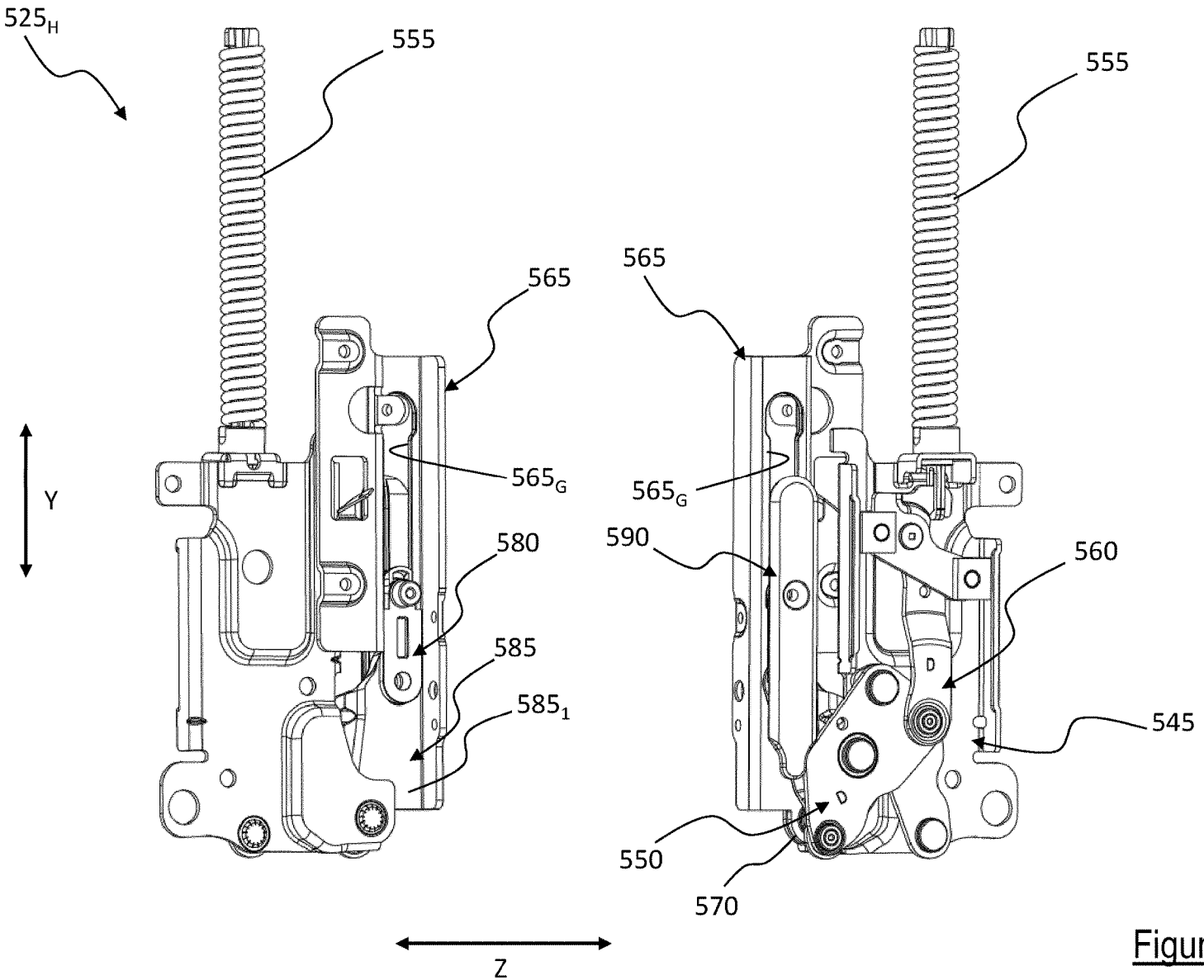
FIGS. 5E-5G show a door hinge of the dishwasher of FIGS. 5A-5D in different operative positions, according to an embodiment of the present invention.
Figure 5F:
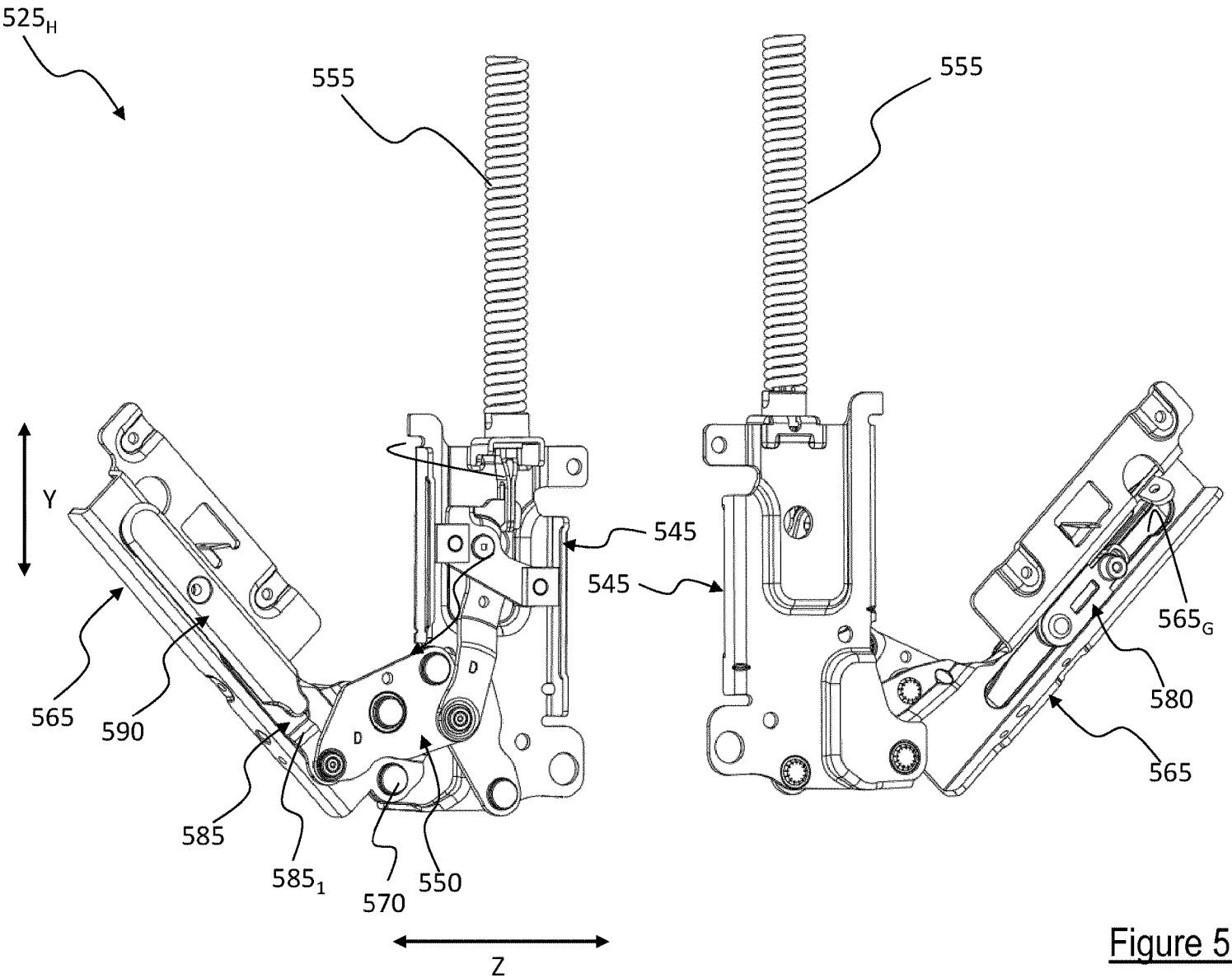
Figure 5G:
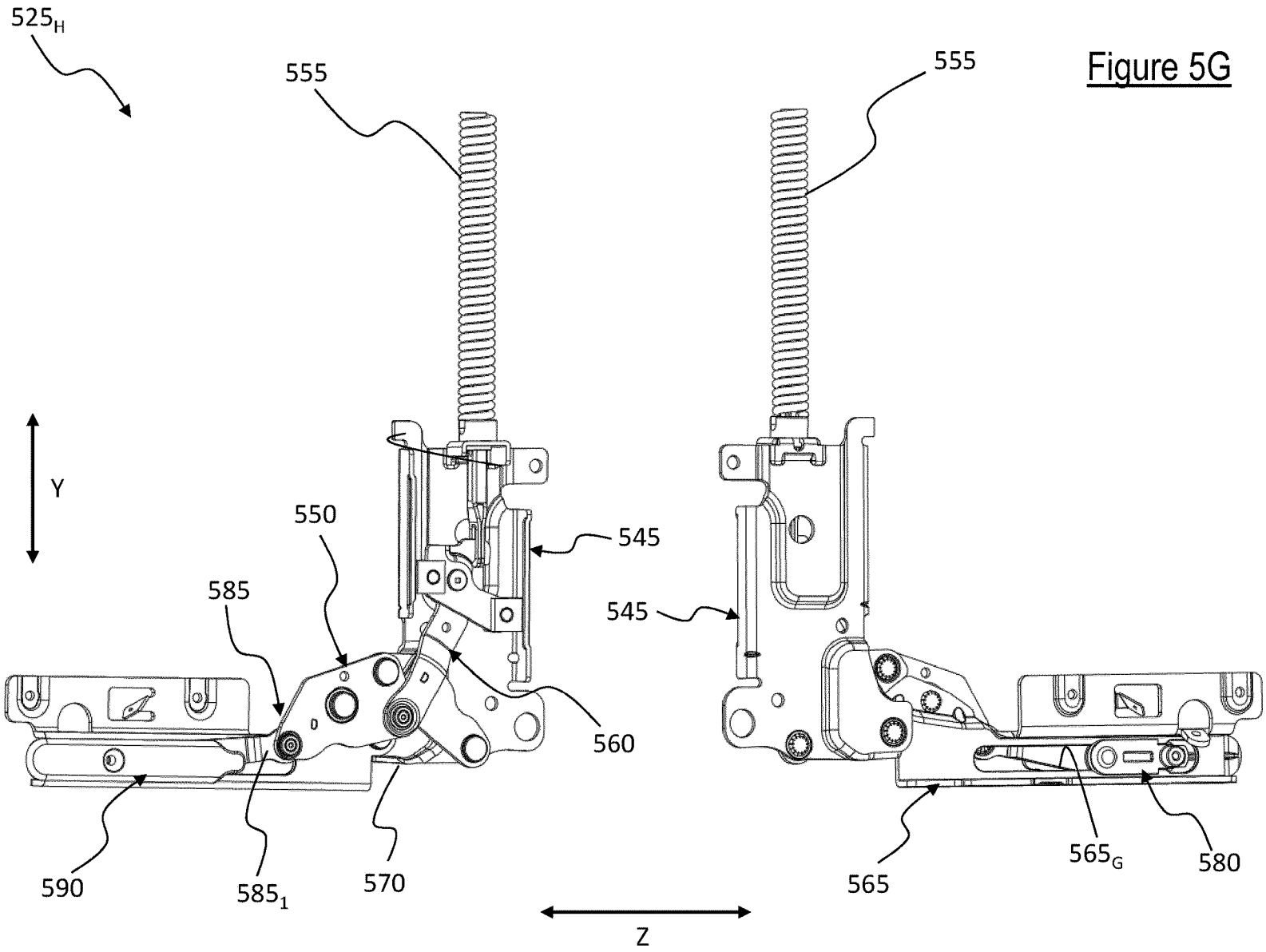

With reference also to FIGS. 5E-5G, they show the door hinge $\mathbf{525}_H$ in different operative positions, according to an embodiment of the present invention (the operative positions of the door hinge $\mathbf{525}_H$ shown in FIGS. 5E-5G for example corresponding to the operative positions of the dishwasher 500 shown in FIGS. 5A-5C, respectively). Particularly, each one of the FIGS. 5E-5G shows the door hinge $\mathbf{525}_H$ in the respective operative position, from opposite sides.

Analogously to the door hinge $\mathbf{125}_H$, according to an embodiment, the door hinge $\mathbf{525}_H$ comprises a support bracket 545 for connecting the door hinge $\mathbf{525}_H$ to the frame 510, a driving mechanism 550, a door balancing device 555, a coupling mechanism 560 for coupling the driving mechanism 550 and the balancing device 555 to each other, a rotating bracket 565 for connecting the door 525 and the door hinge $\mathbf{525}_H$ to each other, a fulcrum pin 570 for rotationally connecting the rotating bracket 565 to the support bracket 545, and an elongated guide structure $\mathbf{565}_G$ provided in the rotating bracket 565.

According to an embodiment, the door hinge $\mathbf{525}_H$ comprises a fastening system analogous to the fastening system of FIGS. 1F-1H, i.e. it comprises the trimming screw 535, a fastening bracket 575 (visible in FIG. 5D) with mutually orthogonal longitudinal $\mathbf{575}_1$ and transverse $\mathbf{575}_2$ plates, and a trimming slotted hole (not visible in these figures) provided in the fastening bracket 575 (particularly, in the transverse plate $\mathbf{575}_2$).

According to an embodiment, the door hinge $\mathbf{525}_H$ comprises a sliding system.

According to an embodiment, the sliding system comprises a sliding member 580, which is slidably guided along the elongated guide structure $\mathbf{565}_G$ of the rotating bracket 565 (analogously to the sliding member of FIGS. 1F-1H). According to an embodiment, the sliding member 580 is configured to be fastened to the cover device 590 (as better discussed in the following).

Analogously to the sliding system of FIGS. 1F-1H, according to an embodiment the sliding system of the door hinge $\mathbf{525}_H$ comprises a crank mechanism 585 connected between the driving mechanism 550 and the sliding member 580 (so as to convert a rocking movement of the driving mechanism 550 into a translation of the sliding member 580.

Analogously to the crank mechanism of FIGS. 1F-1H, according to an embodiment the crank mechanism 585 comprises a transmission arm $\mathbf{585}_1$ coupled, at a first end thereof, to a rocking arm of the driving mechanism 550, and at a second end thereof, to the sliding member 580 by means of a pin.

Figure 6:
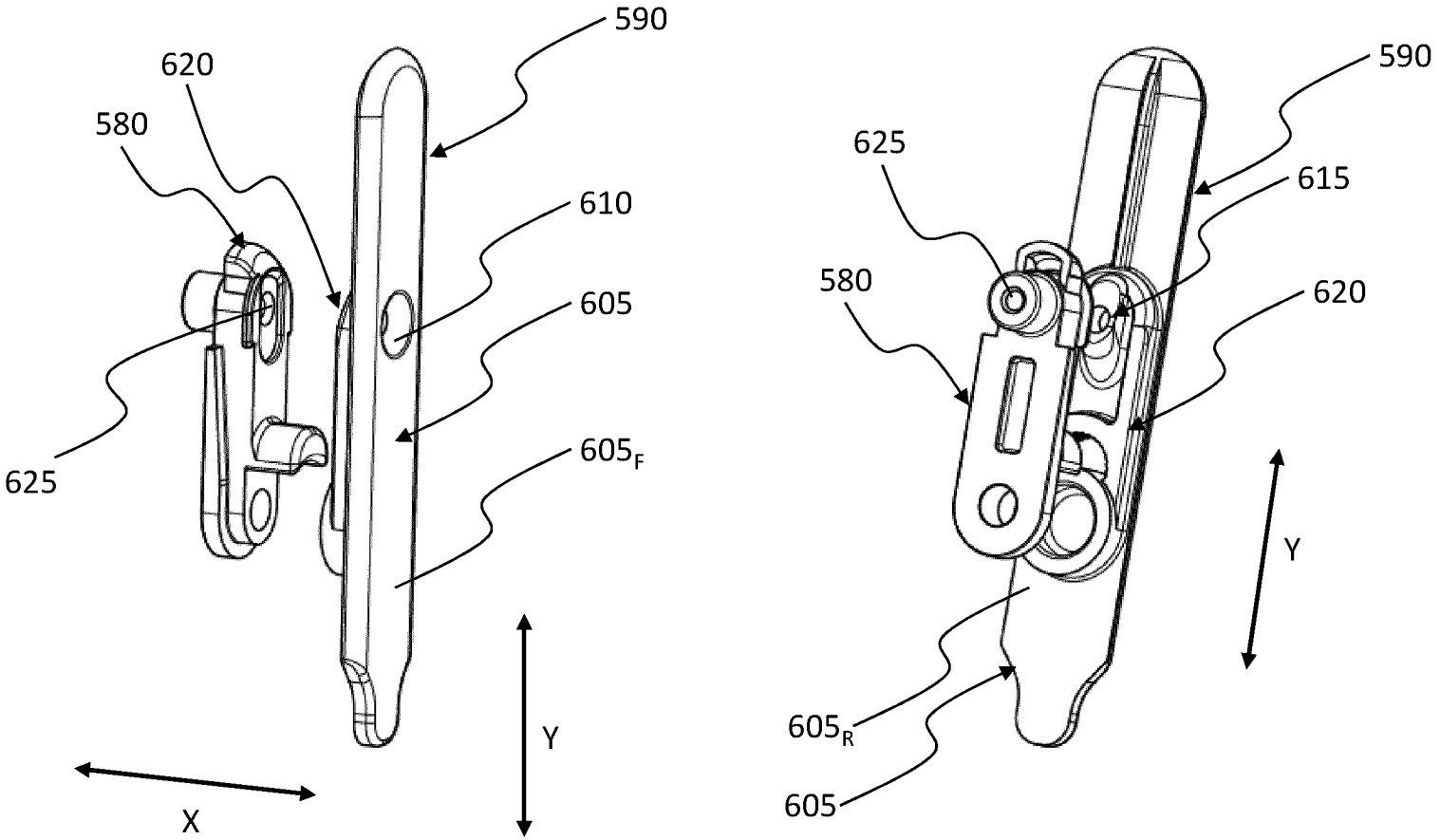
FIG. 6 shows a cover device and a sliding member of the dishwasher of FIGS. 5A-5C according to an embodiment of the present invention.

With reference now to FIG. 6, it shows the cover device 590 and the sliding member 580 according to an embodiment of the present invention.

According to an embodiment, the cover device 590 comprises a plate 605 (e.g., elliptical in shape). According to an embodiment, the plate 605 comprises a front surface $\mathbf{605}_F$ that, in use, faces the inner face of the side wall of the outer door panel $\mathbf{525}_O$, and a rear surface $\mathbf{605}_R$ (opposite to the front surface $\mathbf{605}_F$) that, in use, faces the sliding member 580.

According to an embodiment, the cover device 590 comprises, e.g. on the plate 605, one or more access holes for allowing the user or the operator to access the trimming screw 535. According to an embodiment, the cover device 590 comprises, e.g. on the plate 605, a single access hole 610 (e.g., circular in shape) for allowing the user or the operator to access the trimming screw 535 through the access aperture 540 (i.e. when the access hole 610, with the trimming screw 535 fitted thereinto, and the access aperture 540 are aligned to each other, as discussed in the following).

According to an embodiment, the cover device 590 is configured to be mounted on the sliding member 580. According to an embodiment, the cover device 590 is configured to be snap-fitted on the sliding member 580. According to an embodiment, the cover device 590 comprises an engaging region 615 configured to engage a respective engaging member of the sliding member 580.

According to an embodiment, the engaging region 615 is provided, along the vertical axis Y, below the access hole 610. According to an embodiment, the engaging region 615 comprises a slot having a semicircular (or substantially semicircular) shape.

According to an embodiment, the engaging region 615 is provided in a spacing member 620 of the cover device 590 extending or protruding from the rear surface $\mathbf{605}_R$ of the plate 605, orthogonally thereto. According to an embodiment, the engaging region 615 extends through the spacing member 620 towards the front surface $\mathbf{605}_F$ of the plate 605. According to an embodiment, the engaging region 615 does not reach (i.e. it does not open to) the front surface $\mathbf{605}_F$ of the plate 605, whereby the front surface $\mathbf{605}_F$ of the plate 605 (which provides the closing or covering function of the cover device 590) is mainly solid (exception made for the access hole 610).

According to an embodiment, the spacing member 620 protrudes (along the longitudinal direction X) to such an extent that the cover device 590 is allowed to be snap fitted on the sliding member 580 with interposition of the fastening bracket 575 and of the rotating bracket 565 (as better discussed here below).

According to an embodiment, the sliding member 580 comprises a threaded hole 625 adapted to receive the trimming screw 535. According to an embodiment, upon mounting (e.g., snap fitting) of the cover device 590 on the sliding member 580, the threaded hole 625 of the sliding member 580 is aligned with the access hole 610 of the cover device 590, whereby the trimming screw 535 can be inserted through the access hole 610 and the threaded hole 620.

As visible in FIG. 5D, according to an embodiment, the fastening bracket 575 (particularly, the transverse plate $575_2$ thereof) is fastened between the sliding member 580 and the cover device 590. According to an embodiment, upon mounting (e.g., snap fitting) of the cover device 590 on the sliding member 580 with interposition of the fastening bracket 575 (particularly, the transverse plate $575_2$ thereof), the threaded hole 625 of the sliding member 580 is aligned with the access hole 610 of the cover device 590 and with the trimming slotted hole $575_H$ of the fastening bracket 575 (particularly, of the transverse plate $575_2$ thereof): therefore by insertion (and screwing) of the trimming screw 535 through the access hole 610, the trimming slotted hole $575_H$ and the threaded hole 625, the fastening bracket 575 is gripped between the sliding member 580 and the cover device 590.

As visible in FIG. 5D, according to an embodiment, the rotating bracket 565 is gripped between the sliding member 580 and the fastening plate 575 (particularly, the transverse plate $575_2$ thereof). According to an embodiment, upon mounting (e.g., snap fitting) of the cover device 590 on the sliding member 580 with interposition of the fastening bracket 575 (particularly, the transverse plate $575_2$ thereof) and of the rotating bracket 565, the threaded hole 625 of the sliding member 580 is aligned with the access hole 610 of the cover device 590, with the trimming slotted hole $575_H$ of the fastening bracket 575 (particularly, of the transverse plate $575_2$ thereof) and with the elongated guide structure $565_G$ of the rotating bracket 565: therefore by insertion (and screwing) of the trimming screw 535 through the access hole 610, the trimming slotted hole $575_H$, the threaded hole 625, and the elongated guide structure $565_G$, the fastening bracket 575/sliding member 580/cover device 590 assembly is allowed to slide along the elongated guide structure $565_G$.

As visible in FIGS. 5A and 5E, when the door 525 is in the closed position, the rotating bracket 565 extends along the vertical axis Y in contact with the support bracket 545, and the sliding member 580 (as well as the fastening bracket 575 and the cover device 590 coupled thereto) is at a lower position along the elongated guide structure $565_G$. The access aperture 540 is covered by the cover device 590.

As visible in FIGS. 5B and 5F, when the door 525 is in a partially open position, the rotating bracket 565 (connected to the door 525) rotates with respect to the support bracket 545 about the fulcrum pin 570, so as to move away from the support bracket 545 (connected to the frame 510, not shown in this figure). The corresponding rotation of the rocking arm of the driving mechanism 550 pushes the transmission arm $585_1$ away from the fulcrum pin 570, so as to translate the sliding member 580 (as well as the fastening bracket 575 and the cover device 590 coupled thereto) along the elongated guide structure $565_G$. As visible in the figures, in this position the access hole 610 of the cover device 590 is aligned with the access aperture 540 of the door 525, whereby the trimming screw 535 is accessible by the user for adjusting the vertical position of the decorative front panel 530 on the door 525 and/or for disassembling the decorative front panel 530 from the door 525.

As visible in FIGS. 5C and 5G, the rotation of the rotating bracket 565 (and, hence, the opening of the door 525, not shown in this figure) stops when it reaches a maximum opening angle of about 85-90° (for example, with the rotating bracket 565 that abuts against a bottom of the support bracket 545). According to an embodiment, in this position the sliding member 580 (as well as the fastening bracket 575 and the cover device 590 coupled thereto) reaches an end of stroke of the elongated guide structure $565_G$. The access aperture 540 is covered by the cover device 590.

Therefore, the cover device 590 is configured to automatically move from the opening position to the closing position in response to each movement of the door 525 between the closed position and the open position.

The automatic movement of the cover device 590 at each door movement allows avoiding to rely on the user or the operator to uncover the access aperture 540 to access the trimming screw 535.

Moreover, the cover device 590 is configured to uncover the access aperture 540 only at a single rotation angle of the door (in the example at issue, the rotation angle of FIGS. 5B and 5F), the access aperture 540 being instead covered or closed in any other door position.

As should be understood, although the cover device 590 allows accessing the access aperture 540 during door movement, this does not determine any injury issue: indeed, the sliding member 580 is spaced apart (through the fastening bracket) from the cover device 590, and furthermore the sliding member 580 slides together with the cover device 590: the possibility of introducing fingers between the cover device 590 and the sliding member 580 is therefore avoided.

Naturally, in order to satisfy local and specific requirements, a person skilled in the art may apply to the invention described above many logical and/or physical modifications and alterations. More specifically, although the present invention has been described with a certain degree of particularity with reference to preferred embodiments thereof, it should be understood that various omissions, substitutions and changes in the form and details as well as other embodiments are possible. In particular, different embodiments of the invention may even be practiced without the specific details set forth in the preceding description for providing a more thorough understanding thereof; on the contrary, well-known features may have been omitted or simplified in order not to encumber the description with unnecessary details. Moreover, it is expressly intended that specific elements and/or method steps described in connection with any disclosed embodiment of the invention may be incorporated in any other embodiment.

The invention claimed is:

1. A dishwasher comprising:

a frame defining a treatment chamber for items to be washed;

a door assembly comprising:

a door movable between a closed position and an open position for selectively accessing the treatment chamber, the door comprising an access aperture;

a front panel configured to be coupled with the door, wherein the access aperture is configured to allow a user to access an adjusting member operably coupled with at least one of the door and the front panel and actuatable to adjust a position of a the front panel with respect to the door, and a sliding member configured to slide along a sliding axis during movement of the door between the closed position and the open position, the sliding member being coupleable to the front panel such that, when coupled to the front panel, a sliding of the sliding member during movement of the door between the closed position and the open position causes the front panel to slide with respect to the door along the sliding axis, and a cover device configured to be mounted on the door assembly and configured to take, when mounted on the door assembly, a first operative position in which the cover device leaves the access aperture of the door uncovered and a second operative position in which the cover device covers at least partially the access aperture of the door, wherein the cover device is configured to mechanically cooperate with the sliding member as the sliding member slides along the sliding axis such that the cover device moves from the first operative position to the second operative position in response to the sliding of the sliding member.

2. The dishwasher according to claim 1, wherein the cover device is mounted on the door.

3. The dishwasher according to claim 1, wherein the door comprises a guiding member configured to guide the cover device between the first operative position and the second operative position, the cover device being configured to move between the first operative position to the second operative position by sliding along the guiding member.

4. The dishwasher according to claim 3, wherein the guiding member comprises a guiding aperture provided at a side wall of the door.

5. The dishwasher according to claim 1, wherein the adjusting member is mechanically coupled to the sliding member so as to slide integrally to the sliding member during movement of the door between the closed position and the open position, and wherein the cover device comprises an interception member configured to intercept the adjusting member during sliding thereof, while moving the door from the closed position to the open position, the sliding of the adjusting member exerting on the interception member a force along the sliding axis that causes the cover device to move from the first operative position to the second operative position.

6. The dishwasher according to claim 5, wherein the cover device comprises an engaging member configured to engage an engaging region of the door in the first operative position of the cover device, said force causing the engaging member to disengage from the engaging region of the door so as to move the cover device towards the second operative position.

7. The dishwasher according to claim 6, wherein the cover device is configured to resiliently bend to allow the engaging member to disengage from the engaging region of the door so as to move the cover device from the first operative position to the second operative position.

8. The dishwasher according to claim 5, wherein the cover device comprises an engaging member configured to engage an engaging portion of the door in the second operative position of the cover device, said force causing the engaging member to engage the engaging portion of the door.

9. The dishwasher according to claim 8, wherein the cover device is configured to automatically move from the first operative position to the second operative position in response to a first movement of the door between the closed position and the open position, the engaging between the engaging member and the engaging portion allowing the cover device to be maintained in the second operative position at each movement of the door between the closed position and the open position following the first movement of the door between the closed position and the open position.

10. The dishwasher according to claim 1, wherein the cover device is configured to be manually moved from the second operative position to the first operative position.

11. The dishwasher according to claim 10, wherein the door is configured to rotate between the closed and open positions about a rotation axis, the cover device being configured to be manually moved from the second operative position to the first operative position when the door is rotated with respect to the rotation axis by at least one predetermined rotation angle.

12. The dishwasher according to claim 1, wherein the access aperture is provided on a side wall of the door, and the cover device is mounted on an external face of the side wall of the door.

13. The dishwasher according to claim 1, further comprising, at a side wall of the door, a guiding aperture configured to guide the cover device between the first and second operative positions.

14. The dishwasher according to claim 1, wherein the cover device comprises at least one frictional member configured to provide a frictional coupling between the cover device and the door.

15. The dishwasher according to claim 1, wherein the cover device comprises at least one reinforcing member configured to reinforce a coupling between the cover device and the door when the cover device is in the first operative position.

16. The dishwasher according to claim 15, wherein the reinforcing member is configured to abut against the access aperture when the cover device is in the first operative position.

17. The dishwasher according to claim 1, wherein the cover device comprises an anti-release member configured to prevent the cover device from being accidentally decoupled from the door when the cover device is in the second operative position.

18. The dishwasher according to claim 17, wherein the anti-release member is configured to abut against a portion of the access aperture when the cover device is in the second operative position.

19. The dishwasher according to claim 1, wherein the cover device comprises a plate having an access hole matching the access aperture of the door in the first operative position of the cover device.

20. The dishwasher according to claim 1, wherein the door comprises an engaging hole configured to engage the cover device and the door in the first operative position, the cover device being configured to engage a portion of the access aperture in the second operative position.

21. The dishwasher according to claim 1, wherein the sliding member is configured to slide, along the sliding axis, in a first direction when the door is moved from the closed position to the open position and in a second direction, opposite the first direction, when the door is moved from the open position to the closed position, the cover device moving in the first direction while automatically moving from first operative position to the second operative position, and wherein the cover device is configured to be manually moved from the second operative position to the first operative position by exerting on the cover device a pulling force orthogonal to the sliding axis and a force in the second direction.

22. The dishwasher according to claim 1, wherein the cover device comprises at least one grip member configured to allow the user to grasp the cover device.

23. The dishwasher according to claim 1, wherein the access aperture is provided at a side wall of the door, the cover device being mounted on an internal face of the side wall of the door.

24. The dishwasher according to claim 23, comprising a guiding aperture provided at a front wall of the door orthogonal to the side wall of the door and configured to guide the cover device between the first operative position and the second operative position, wherein the cover device comprises a plate configured to rest on the internal face of the side wall of the door, and an overhanging member projecting from the plate and configured to be coupled to the guiding aperture.

25. The dishwasher according to claim 24, wherein the overhanging member is configured to engage the door.

26. The dishwasher according to claim 23, wherein the cover device comprises at least one frictional member configured to provide a frictional coupling between the cover device and the door.

27. The dishwasher according to claim 23, wherein the sliding member is configured to slide, along the sliding axis, in a first direction when the door is moved from the closed position to the open position and in a second direction, opposite the first direction, when the door is moved from the open position to the closed position, the cover device moving in the first direction while automatically moving from first operative position to the second operative position, and wherein the cover device is configured to be manually moved from the second operative position to the first operative position by exerting on the cover device a pushing force orthogonal to the sliding axis and a force in the second direction.

28. The dishwasher according to claim 1, wherein the cover device is mounted on the sliding member, whereby the cover device is configured to move from the first operative position to the second operative position when the door is moved from the closed position to the open position and to move from the second operative position to the first operative position when the door is moved from the open position back to the closed position.

29. The dishwasher according to claim 28, wherein the cover device is mounted on the sliding member by snap-fitting.

* * * * *